US006313581B1

(12) United States Patent
Machida

(10) Patent No.: US 6,313,581 B1
(45) Date of Patent: Nov. 6, 2001

(54) ELECTRICAL DISCHARGE TUBE HAVING TRIGGER WIRES

(75) Inventor: Kazuhiko Machida, Nagano (JP)

(73) Assignee: Shinko Electric Industries Co. Ltd. (JP)

( * ) Notice: Subject to any disclaimer, the term of this patent is extended or adjusted under 35 U.S.C. 154(b) by 0 days.

(21) Appl. No.: 09/614,747

(22) Filed: Jul. 12, 2000

(30) Foreign Application Priority Data

Jul. 16, 1999 (JP) ..... 11-203184
Apr. 12, 2000 (JP) ..... 12-110213

(51) Int. Cl.[7] ..... H01J 61/54

(52) U.S. Cl. ..... 313/603; 313/631; 313/231.01; 361/120; 361/129

(58) Field of Search ..... 313/601, 602, 313/603, 631, 231.11; 361/120, 129; 315/326, 335

(56) References Cited

U.S. PATENT DOCUMENTS 4,578,733 * 3/1986 Shigemori et al. ..... 361/120
4,644,441 * 2/1987 Igarashi ..... 361/120
5,671,114 * 9/1997 Daumer et al. ..... 361/120
5,739,637 * 4/1998 Boettcher ..... 313/602
5,995,355 * 11/1999 Daeumer ..... 361/120
6,025,672 2/2000 Machida ..... 313/231.11

* cited by examiner

*Primary Examiner*—Michael H. Day
(74) *Attorney, Agent, or Firm*—Paul & Paul

(57) ABSTRACT

An electrical discharge tube comprises a cylindrical body, made of insulating material, having an inner surface, and having end faces defining respective openings. Metallized layers are formed on the respective end faces of the cylindrical body and are substantially parallel to each other. Electrodes airtightly close the respective openings by means of the metallized layers and have respective electrical discharge faces, between which an electrical discharge gap is defined. At least one first electrical discharge trigger wire is formed as a loop on the inner surface of the cylindrical body and extends substantially in parallel to the metallized layers along a first surface located within a range of the electrical discharge gap. At least one second electrical discharge trigger wire is formed on the inner surface of the cylindrical body and extends from the upper metallized layer to a fourth surface located between a second surface including the electrical discharge face of the upper electrode and the upper metallized layer.

17 Claims, 25 Drawing Sheets

ELECTRICAL DISCHARGE TUBE HAVING TRIGGER WIRES

BACKGROUND OF THE INVENTION

1. Field of the Invention

The present invention relates to an electrical discharge tube in which electrical discharges are repeatedly induced between an electrical discharge face at a forward end of an upper discharge electrode and an electrical discharge face at a forward end of a lower discharge electrode which are opposed to each other at the center in an airtight cylinder.

2. Description of the Related Art

Japanese Unexamined Patent Publication No. 10-335042 discloses an electrical discharge tube used for a ballast circuit to ignite an HID (high intensity discharge) lamp of a vehicle and also used for an igniter circuit to ignite a back side lamp of a liquid crystal projector.

As shown in FIGS. 37 and 38, this electrical discharge lamp is provided, in the traverse direction at the center of the inside wall of the airtight cylinder 10, with a plurality of main electrical discharge trigger wires 80 which are arranged at predetermined intervals, while the main electrical discharge trigger wires 80 rise in the vertical direction in parallel with the axis of the airtight cylinder 10. On the upper inside wall of the airtight cylinder 10 between the main electrical discharge trigger wires 80, there are sub-electrical discharge trigger wires 90 which rise in the vertical direction in parallel with the axis of the airtight cylinder 10, and upper ends of these sub-electrical discharge trigger wires 90 are serially connected with the metalized face 40 formed on the upper end face of the airtight cylinder 10. In the same manner, on the lower inside wall of the airtight cylinder 10 between the main electrical discharge trigger wires 80, there are sub-electrical discharge trigger wires 90 which rise in the vertical direction in parallel with the axis of the airtight cylinder 10, and the lower ends of these sub-electrical discharge trigger wires 90 are serially connected with the metalized face 40 formed on the lower end face of the airtight cylinder 10.

In this electrical discharge tube, it is possible to prevent the electrical insulation between the main discharge trigger wires 80 and the sub-discharge trigger wires 90, which are arranged on the inner wall of the airtight cylinder 10, from being deteriorated by sputtering such as carbon particles which are created in the process of discharging from the electrical discharging face 23 at the forward end of the upper discharge electrode, the electrical discharging face 25 at the forward end of the lower discharge electrode, the main electrical discharge trigger wires 80 and the sub-electrical discharge trigger wires 90 and which adhere to the center of the inner wall of the airtight cylinder 10. Further, in this electrical discharge tube, it is possible to repeatedly and stably induce electrical discharges between the electrical discharging face 23 and the electrical discharging face 25 at a predetermined electrical potential over a long period of time.

In general, in an igniter circuit which uses the commercial power source as a power source and performs an electrical discharge synchronizingly with the frequency of that power source, an electrical discharge gap is arranged at the side of the secondary coil opposite to the primary coil of the transformer.

However, there are some ballast circuits or igniter circuits including electrical resistors, coils, or the similar parts mounted at a high density, which are uses for igniting the HID lamp or the like, as mentioned abode. In such a circuit, the electrical discharge tube constituting an electrical discharge gap is arranged close to the primary booster coil in the circuit, and the direction of the winding of the primary booster coil is substantially perpendicular to the direction of the main electrical discharge trigger wires 80 and the sub-electrical discharge trigger wires 90.

Therefore, the main electrical discharge trigger wires 80 and the sub-electrical discharge trigger wires 90 are affected by the magnetic field generated by the primary booster coil, and an electrical current is generated by the electromagnetic induction caused by the main electrical discharge trigger wires 80 and the sub-electrical discharge trigger wires 90. Being affected by the electrical current, the electrical potential of electrical discharges repeatedly induced between the electrical discharge face 23 and the electrical discharge face 25 cannot be stabilized, that is, the electrical potential of electrical discharges fluctuate and, further, the electrical discharge starting voltage initially generated between the electrical discharge face 23 and the electrical discharge face 25 is raised.

The above ballast circuit used for igniting the HID lamp of a vehicle is embedded and fixed in resin such as urethane resin or epoxy resin so that the circuit can be protected from impact and vibration, and the electrical discharge tube composing the ballast circuit is surrounded by the dielectric resin.

Therefore, the electrical discharge tube is affected by the dielectric resin. Accordingly, it is impossible to effectively converge electrons of the corona discharge upon the sub-electrical discharge trigger wires 90 of the electrical discharge tube. Further, the electrical discharge starting voltage initially generated between the electrical discharge face 23 and the electrical discharge face 25 is raised.

SUMMARY OF THE INVENTION

The present invention has been accomplished to solve the above problems. It is an object of the present invention to provide an electrical discharge tube which is not affected by the magnetic field generated by the primary booster coil in the ballast circuit or the igniter circuit and also which is not affected by the resin of the dielectric body surrounding the electrical discharge tube, so that electrical discharges at a predetermined electrical potential can be repeatedly induced and the electrical discharge starting voltage initially can be kept constant for a long time.

According to the present invention, there is provided a first electrical discharge tube which comprises: a cylindrical body, made of insulating material, having an inner surface and having upper and lower end faces defining respective upper and lower openings; upper and lower metallized layers formed on the respective upper and lower end faces of the cylindrical body, the upper and lower metallized layers being substantially parallel to each other; upper and lower electrodes for airtightly closing the respective upper and lower openings by means of the metallized layers, the upper and lower electrodes having respective electrical discharge faces between which an electrical discharge gap is defined; a first electrical discharge trigger wire formed as a loop on the inner surface of the cylindrical body and extending substantially parallel to the first and second metallized layers along a first surface located within a range of the electrical discharge gap; one or more second electrical discharge trigger wires formed on the inner surface of the cylindrical body and extending from the upper metallized layer to a fourth surface located between a second surface including the electrical discharge face of the upper electrode and the upper metallized layer; and one or more other second electrical discharge trigger wires formed on the inner surface of the cylindrical body and extending from the lower metallized layer to a fifth surface located between a third surface including the electrical discharge face of the lower electrode and the lower metallized layer.

According to another aspect of the present invention, there is provided a second electrical discharge tube, which comprises: a cylindrical body, made of insulating material, having an inner surface, and having upper and lower end faces defining respective upper and lower openings; upper and lower metallized layers formed on the respective upper and lower end faces of the cylindrical body, the upper and lower metallized layers being substantially parallel to each other; upper, negative and lower, positive electrodes for airtightly closing the respective upper and lower openings by means of the metallized layers, the upper and lower electrodes having respective electrical discharge faces between which an electrical discharge gap is defined; a first electrical discharge trigger wire formed as a loop on the inner surface of the cylindrical body and extending substantially parallel to the first and second metallized layers along a first surface located within a range of the electrical discharge gap; and a plurality of electrical discharge trigger wires formed on the inner surface of the cylindrical body and extending from the upper metallized layer to a fourth surface located between a second surface including the electrical discharge face of the upper, negative electrode and the upper metallized layer.

In this electrical discharge tube, the first electrical discharge trigger wire arranged at the center of the inside wall of the airtight cylinder crosses the inside wall of the airtight cylinder substantially parallel with the metalized face and is formed into a loop-shape. In other words, the first discharge trigger wire is arranged in the traverse direction perpendicular to the axis of the airtight cylinder.

Due to the above structure, the first electrical discharge trigger wire becomes substantially parallel with the direction of the winding of the primary booster coil in the above ballast circuit and others. Therefore, it is possible to prevent the generation of an electrical current in the first electrical discharge trigger wire by the electromagnetic induction being affected by the magnetic field of the primary booster coil.

As a result, it is possible to prevent a fluctuation of the electrical potential of electrical discharge repeatedly induced being affected by the magnetic field of the primary booster coil. Also, it is possible to keep the electrical discharge starting voltage at the first time constant.

In this structure, the second electrical discharge trigger wire is serially connected with the metalized face formed on the upper or the lower end face of the airtight cylinder. Therefore, this second electrical discharge trigger wire is electrically connected with the upper discharge electrode or the lower discharge electrode via the metalized face.

Therefore, electrons used for creeping corona discharge, which induce electrical discharges between the electrical discharge face of the forward end of the upper discharge electrode and the electrical discharge face of the forward end of the lower discharge electrode, can be effectively converged upon the second electrical discharge trigger wire.

As a result, the electrical discharge starting voltage generated at the first time by the second electrical discharge trigger wire can be stabilized without being raised.

Since the first electrical discharge trigger wire is formed into a loop-shape in the traverse direction at the center of the inside wall of the airtight cylinder, as compared with the conventional electrical discharge tube in which a plurality of main electrical discharge trigger wires and sub-electrical discharge trigger wires are arranged in the traverse direction at predetermined intervals by being raised in the vertical direction of the inside wall of the airtight cylinder, it is possible to keep the distance between the first electrical discharge trigger wire and the second electrical discharge trigger wire arranged close to it on the inside wall of the airtight cylinder constant. When the first electrical discharge trigger wire and the second electrical discharge trigger wire, which are arranged at a constant distance, are used, electrical discharges at a predetermined electrical potential can be repeatedly and stably induced.

When the electrical discharge tube is manufactured, it is enough that the first electrical discharge trigger wire is formed into a loop-shape in the traverse direction at the center of the inside wall of the airtight cylinder. Therefore, as compared with the conventional electrical discharge tube in which the main electrical discharge trigger wires are divided into a plurality of pieces on the inside wall of the airtight cylinder and arranged in the traverse direction while they are directed vertically, the first electrical discharge trigger wire can be easily and quickly formed on the inside wall of the airtight cylinder.

In the second electrical discharge tube, the inside wall portion of the airtight cylinder composed of insulating material, in which no trigger wires exist, is widely arranged between the first electrical discharge trigger wire, which is formed at the center of the inside wall of the airtight cylinder, and the metalized face on the positive electrode side formed on the lower end face of the airtight cylinder.

Therefore, even when spatters created in the process of electrical discharges adhere to a portion on the inside wall between the first electrical discharge trigger wire and the metalized face on the positive electrode side, it is possible to prevent the electrical insulation between the first electrical discharge trigger wire and the metalized face on the positive electrode side from deteriorating.

In the second electrical discharge tube, the aging treatment to activate the electrical discharge faces can be conducted only when a DC over-voltage is impressed between the negative electrode and the positive electrode only in one direction. Therefore, the process of the aging Treatment, which is complicated, can be reduced by half.

In this case, the aging treatment is defined as a treatment in which an over-voltage is repeatedly impressed between the upper discharge electrode and the lower discharge electrode in the case, of manufacturing an electrical discharge tube, so that electrical discharges are repeatedly induced so as to activate the electrical discharge faces. After this aging treatment has been completed, electrical discharges can be smoothly and appropriately induced.

In the first electrical discharge tube of the present invention, it is preferable that one piece of the second electrical discharge trigger wire or a plurality of second electrical discharge trigger wires are arranged in the traverse direction on the upper inside wall and the lower inside wall of the airtight cylinder at predetermined intervals while being alternately shifted.

In this first electrical discharge tube, the second electrical discharge trigger wires, which are formed on the upper inside wall and the lower inside wall of the airtight cylinder while being adjacent to each other, are not arranged opposed to each other in the vertical direction but are arranged in the traverse direction at predetermined intervals. Therefore, it is possible to appropriately prevent the electrical insulation of the second electrical discharge trigger wires, which are formed on the upper inside wall and the lower inside wall of the airtight cylinder, from being deteriorated by the spatters adhering to the center of the inside wall of the airtight cylinder in the process of electrical discharge.

In the electrical discharge tube of the present invention, it is preferable that the second electrical discharge trigger wires are composed of a plurality of the sub-second electrical discharge trigger wires which are arranged close to each other substantially in parallel with each other.

In the electrical discharge tube of the present invention, when electrical discharges are repeatedly induced, it is possible to not raise the electrical discharge starting voltage at the first time, so that the electrical discharge starting voltage at the first time can be stabilized at a constant value over a long period of time.

The above effect is remarkable especially when the electrical discharge tube is placed in a dark place and electrical discharges are repeatedly induced in a gas in which electrons in the space of the airtight cylinder of the electrical discharge tube are not excited. In this case, the electrical discharge starting voltage at the first time can be kept constant and the life of the electrical discharge tube can be greatly extended.

The reason is as follows. In the case where the number of the second electrical discharge trigger wires is one, when electrical discharges are repeatedly induced, a forward end of the second electrical discharge trigger wire made of carbon, which is formed on the inside wall of the airtight cylinder close to the electrical discharge face, is changed into spatters being affected by the electrical discharges, and the thus formed spatters spread in the airtight cylinder and disappear quickly.

Further, the distance from the forward end of a single, second electrical discharge trigger wire, to the electrical discharge face of the upper discharge electrode or the electrical discharge face of the lower discharge electrode is gradually extended.

As a result, when the single, second electrical discharge trigger wire, the length of which is short because the forward end of the trigger wire is lost, is used, the electrical discharge starting voltage at the first time is gradually raised early.

On the other hand, in the case of the second electrical discharge trigger wires composed of a plurality of the sub-second electrical discharge trigger wires which are arranged close to each other and in parallel with each other, when electrical discharges are repeatedly induced, forward end portions of some of a plurality of the sub-second electrical discharge trigger wires arranged in parallel with each other, which are made of carbon and formed on the inside wall of the airtight cylinder close to the electrical discharge face, change into spatters and disperse in the space of the airtight cylinder and disappear quickly. Even so, forward end portions of others of the sub-second electrical discharge trigger wires do not disappear and remain over a long period of time as they are.

The forward ends of the plurality of sub-second electrical discharge trigger wires of the second electrical discharge trigger wire, which remains long, is not separated from the electrical discharge face of the forward end of the upper discharge electrode arranged close to it or the electrical discharge face of the forward end of the lower electrical discharge electrode.

As a result, by using the plurality of sub-second electrical discharge trigger wires, the forward end of which is not lost and remains long over a long period of time, the electrical discharge initial voltage induced repeatedly can not be raised but is kept constant.

In this connection, the following were confirmed by an experiment made by the present inventors. When a plurality of the sub-second electrical discharge trigger wire composing the second electrical discharge trigger wires are arranged too close to each other, the function of the plurality of the sub-second electrical discharge trigger wires becomes the same as the function of the second electrical discharge trigger wire, the number of which is one. Therefore, when the second electrical discharge trigger wires composed of the plurality of the sub-second electrical discharge trigger wires, which are arranged too close to each other, are used, the electrical discharge initial voltage of the electrical discharge tube is gradually raised at a dark place in its early stages.

When the plurality of the sub-second electrical discharge trigger wires composing the second electrical discharge trigger wires are arranged too distant from each other, each of the plurality of the sub-second electrical discharge trigger wires has the same function as that of the second electrical discharge trigger wire, the number of which is one. Therefore, when the plurality of the sub-second electrical discharge trigger wires, which are arranged too distant from each other, are used, the electrical discharge starting voltage of the electrical discharge tube at the first time is gradually raised at a dark place in its early stages.

That is, the following were confirmed by an experiment made by the present inventors. When the plurality of the sub-second electrical discharge trigger wires composing the second electrical discharge trigger wires are used, it is necessary to adjust a distance from one trigger wire to another trigger wire according to the discharge starting voltage and the size of the airtight cylinder.

In the electrical discharge tube of the present invention, it is preferable that the second electrical discharge trigger wire is oblique with respect to the axis of the airtight cylinder.

In this electrical discharge tube, the second electrical discharge trigger wire is oblique with respect to the axis of the airtight cylinder. Further, the second electrical discharge trigger wire is obliquely directed in the upward and downward direction which is close to the direction of the windings of the primary booster coil of the ballast circuit and the igniter circuit.

Therefore, it is possible to prevent an electric current being generated in the second electrical discharge trigger wire being affected by the magnetic field of the primary booster coil. Further, it is possible to prevent the electrical discharge potential, which is repeatedly generated, and the electrical discharge starting voltage at the first time from fluctuating being affected by the electrical current.

Even if the airtight cylinder is surrounded by a resin made of dielectric material, electrical discharges are induced in the second oblique electrical discharge trigger wire but are not affected by the resin. Therefore, the electrons of creeping corona discharge can be effectively converged. It is possible to prevent the electrical discharge starting voltage at the first time from rising by using this second electrical discharge trigger wire.

In the first or the second electrical discharge tubes of the present invention, it is possible to adopt the following structure. At the center of the inside wall of the airtight cylinder located between the second plane and the third plane, instead of one piece of the first electrical discharge trigger wire, a plurality of the first electrical discharge trigger wires are symmetrically arranged on both sides of the first plane in parallel with the metalized face while the plurality of the first electrical discharge trigger wires cross the inside wall of the airtight cylinder in a loop-shape being arranged in the vertical direction at predetermined intervals.

In this first or the second electrical discharge tube, it is possible to prevent the first electrical discharge trigger wire arranged outside the first electrical discharge trigger wires coming to close to the upper discharge electrode located outside the second plane or the lower discharge electrode located outside the third plane. Due to the foregoing, it is possible to prevent the electrical discharge potential from being lowered.

A plurality of the first electrical discharge trigger wires are arranged in the traverse direction on the inside wall of the airtight cylinder so that the plurality of the first electrical discharge trigger wires can be substantially parallel with the direction of the windings of the primary booster coils of the ballast circuit and the igniter circuit. Therefore, it is possible to prevent an electrical current to be generated in the plurality of the first electrical discharge trigger wires by the electromagnetic induction being affected by the magnetic field of the primary booster coil. Further, it is possible to prevent the electrical discharge potential, which is repeatedly generated, and the electrical discharge starting voltage at the first time from fluctuating by being affected by the electrical current.

In the electrical discharge tube of the present invention, the fist electrical discharge tube may have one or a plurality of interruptions in its intermediate portion.

Even in this case, in the same manner as that of the first electrical discharge trigger wire having no interruptions, the electrons of the corona electrical discharge can be effectively converged so that electrical discharges can be induced. By using the first electrical discharge trigger wire having interruptions, electrical discharges at a predetermined electrical potential can be repeatedly and stably induced.

DETAILED DESCRIPTION OF THE EMBODIMENTS

Figure 1:
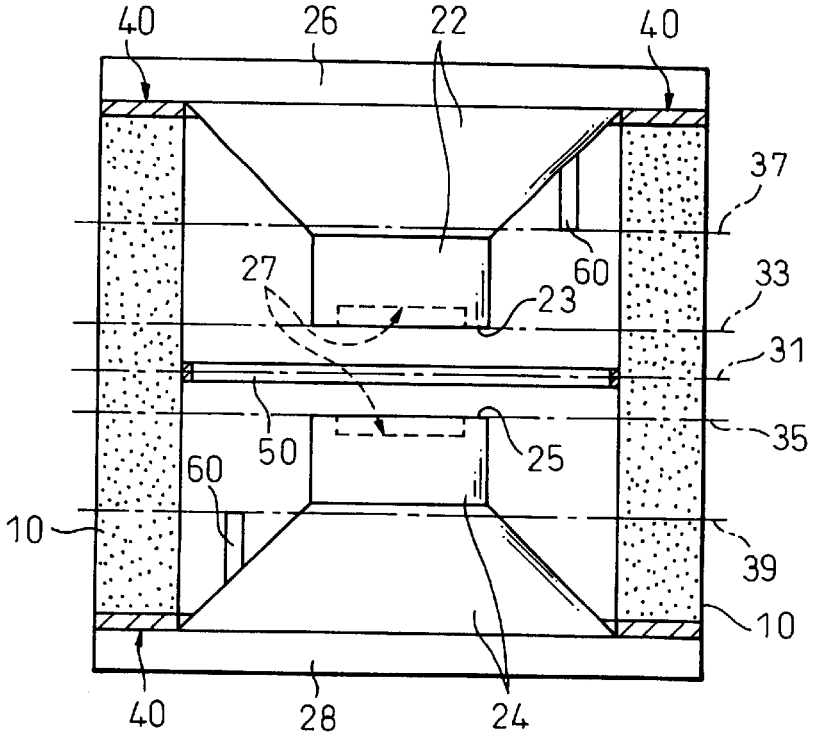
FIG. 1 is a cross-sectional front view of the first electrical discharge tube of the present invention.
Figure 2:
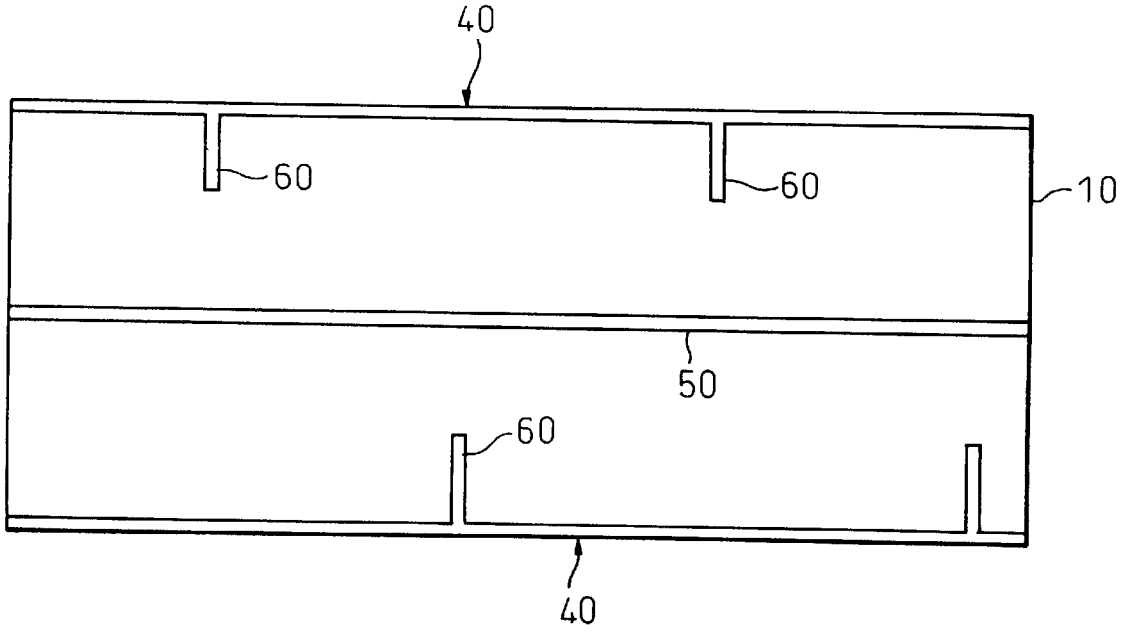
FIGS. 2 and 3 are development views respectively showing an inside wall of an airtight cylinder of the first electrical discharge tube.

Referring to FIGS. 1 and 2, the first electrical discharge tube will be explained below.

In the drawings, reference numeral 10 is an airtight cylinder made of insulating material such as ceramics. The upper end opening and the lower end opening of the airtight cylinder 10 are respectively covered with the upper electrical discharge electrode 22 and the lower electrical discharge electrode 24 made of metal such as 42 alloy (iron-nickel alloy). Specifically, the outside end portions of the upper electrical discharge electrode 22 and the lower electrical discharge electrode 24 are formed into disk-shaped covers 26, 28, and the upper end opening and the lower end opening of the airtight cylinder 10 are covered with the covers 26, 28.

The upper electrical discharge electrode 22 and the lower electrical discharge electrode 24 are airtightly joined to the metalized faces 40 by means of soldering which are formed on the upper end face and the lower end face of the airtight cylinder 10 and made of metal such as chrome. The inside space of the airtight cylinder 10, into which a mixed inert gas is charged, is airtightly sealed by the upper electrical discharge electrode 22 and the lower electrical discharge electrode 24.

A forward end of the upper electrical discharge electrode 22 and a forward end of the lower electrical discharge electrode 24, which are housed inside the airtight cylinder 10, are respectively formed into a column-shape, the diameter of which is small. The forward end of the upper electrical discharge electrode 22 and the forward end of the lower electrical discharge electrode 24 are opposed to each other at the center of the airtight cylinder 10. A recess 27 is provided respectively on the electrical discharge face 23 at the forward end of the upper electrical discharge electrode and the electrical discharge face 25 at the forward end of the lower electrical discharge electrode, so that electrical discharges can be stably induced between the electrical discharge faces 23, 25.

Although the above structure is the same as that of the conventional electrical discharge tube, the following structure of the first electrical discharge tube shown in the drawing is different from the structure of the conventional electrical discharge tube. In the first electrical discharge tube shown in the drawing, at the center of the inside wall of the airtight cylinder 10 located on the first plane (shown by one-dotted chain line in the drawing) which crosses the center of the electrical discharge gap between the electrical discharge face 23 and the electrical discharge face 25 opposed to each other at the center in the airtight cylinder 10, as shown in FIG. 2, one piece of the first electrical discharge trigger wire 50 composed of a carbon wire, the width of which is about 0.5 mm, is arranged substantially in parallel with the metalized face 40 in a loop-shape in such a manner that the first electrical discharge trigger wire 50 crosses the inside wall of the airtight cylinder 10.

On the upper inside wall of the airtight cylinder 10, one piece of, or a plurality of, the second electrical discharge trigger wires 60, which are composed of carbon wires, the wire width of which is about 0.5 mm, are arranged in such a manner that their forward end portions are located on the substantially same face as the fourth plane 37 which crosses the center between the second plane 33 including the electrical discharge face 23 and the metalized face 40 on the upper electrical discharge electrode 22 side while one piece or the plurality of the second electrical discharge trigger wires 60 are arranged in parallel with the axial direction of the airtight cylinder 10 in the traverse direction being raised. The rear end of one piece of the second electrical discharge trigger wire 60 or rear ends of a plurality pieces of the second electrical discharge trigger wires 60, which are formed on the upper inside wall of the airtight cylinder 10, are serially connected with the metalized face 40 formed on the upper end face of the airtight cylinder 10 close to it.

On the lower inside wall of the airtight cylinder 10, one piece or a plurality of the second electrical discharge trigger wires 60, which are composed of carbon wires, the wire width of which is about 0.5 mm, are arranged in such a manner that their forward end portions are located on substantially the same face as the fifth plane 39 which crosses the center between the third plane 35 including the electrical discharge face 25 and the metalized face 40 on the lower electrical discharge electrode 24 side while one piece of or the plurality of the second electrical discharge trigger wires 60 are arranged in parallel with the axial direction of the airtight cylinder 10 in the traverse direction being raised. A rear end of one piece of the second electrical discharge trigger wire 60 or rear ends of a plurality pieces of the second electrical discharge trigger wires 60, which are formed on the lower inside wall of the airtight cylinder 10, are serially connected with the metalized face 40 formed on the lower end face of the airtight cylinder 10.

As shown in FIG. 2, one piece or a plurality of pieces of the second electric discharge trigger wires 60 are arranged on the upper inside wall and the lower inside wall at predetermined intervals in the traverse direction being alternately shifted from each other. The second electrical discharge trigger wires 60, which are formed on the upper inside wall and the lower inside wall of the airtight cylinder 10 being adjacent to each other, are not arranged being opposed to each other in the vertical direction but are arranged in the traverse direction at predetermined intervals. Therefore, it is possible to prevent the occurrence of electrical shortage of the second electrical discharge trigger wires 60, which are formed on the upper inside wall and the lower inside wall of the airtight cylinder, from being caused by the spatters adhering to the center of the inside wall of the airtight cylinder 10 in the case of electrical discharge conducted by the electrical discharge face 23, the electrical discharge face 25, the first electrical discharge trigger wire 50 and the second electrical discharge trigger wire 60.

Next, referring to FIG. 3, a variation on the first electrical discharge tube will be explained below.

In the variation of the first electrical discharge tube, at the center of the inside wall of the airtight cylinder 10 located between the second plane 33 and the third plane 35, instead of one piece of the first electrical discharge trigger wire 50, a plurality of pieces of the first electrical discharge trigger wires 50 (two pieces of the first electrical discharge trigger wires 50 are shown in the drawing) made of carbon, the wire width of which is about 0.2 mm, are symmetrically arranged on both sides of the first plane 31 substantially in parallel with the metalized face 40 in a loop-shape at predetermined intervals in the vertical direction while the first electrical discharge trigger wires 50 cross the inside wall of the airtight cylinder 10.

Other points of the variation are the same as those of the first electrical discharge tube shown in FIGS. 1 and 2.

Figure 4:
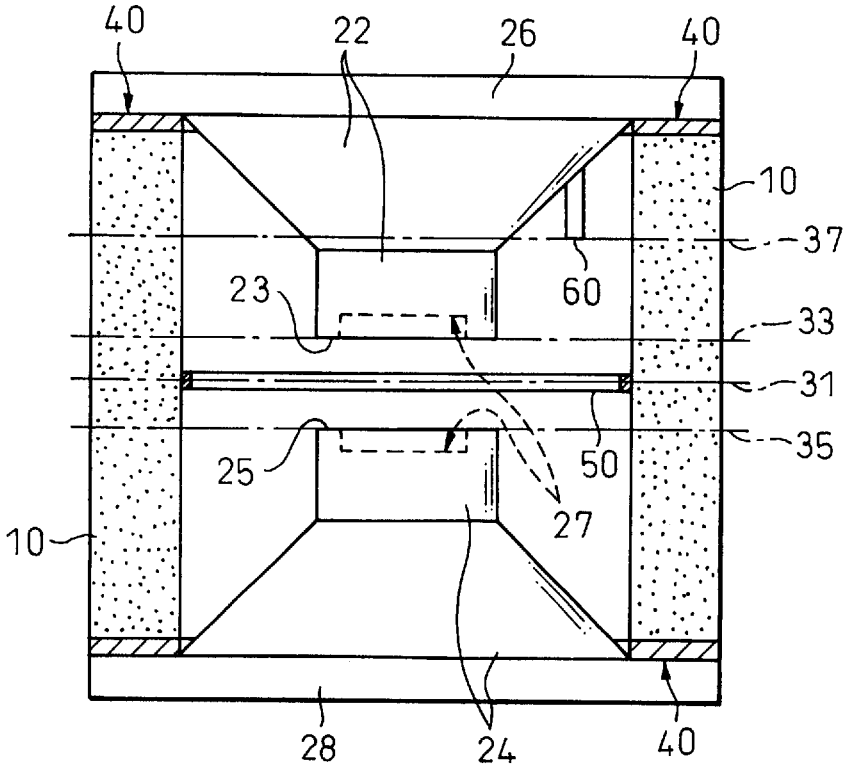
FIG. 4 is a cross-sectional front view of the second electrical discharge tube of the present invention.
Figure 5:
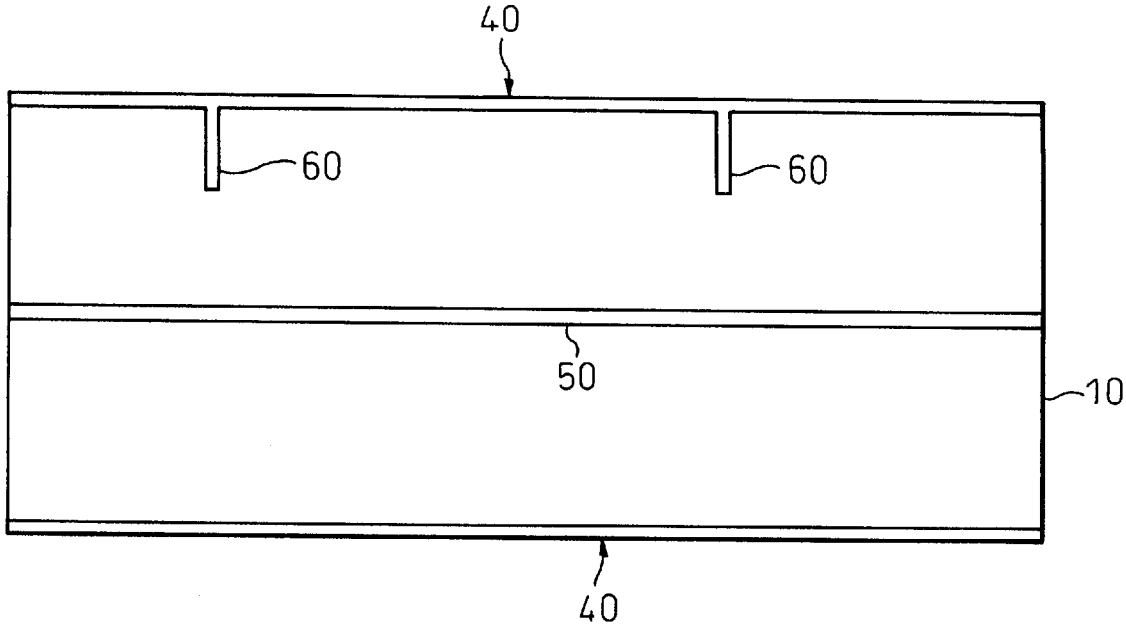
FIGS. 5 and 6 are development views respectively showing an inside wall of an airtight cylinder of the second electrical discharge tube of the present invention.

Referring to FIGS. 4 and 5, the second electrical discharge tube will be explained below.

In the same manner as that of the first electrical discharge tube shown in FIGS. 1 and 2, in this second electrical discharge tube, on the upper inside wall of the airtight cylinder 10 which corresponds to the negative electrode side, not less than two second electrical discharge trigger wires 60 (two second electrical discharge trigger wires 60 are shown in the drawing), which are composed of carbon wires, the wire width of which is about 0.5 mm, are arranged in such a manner that their forward end portions are located on the substantially same face as the fourth plane 37 which crosses the center between the second plane 33 including the electrical discharge face 23 and the metalized face 40 on the upper electrical discharge electrode 22 side while the plurality of the second electrical discharge trigger wires 60 are arranged in parallel with the axial direction of the airtight cylinder 10 in the traverse direction being raised. Rear ends of the plurality pieces of the second electrical discharge trigger wires 60 are serially connected with the metalized face 40 formed on the upper end face of the airtight cylinder 10.

On the lower inside wall of the airtight cylinder 10 which corresponds to the positive electrode side, no second electrical discharge trigger wires 60 exist, and the inside wall portion of the airtight cylinder 10 made of insulating material is widely exposed.

Other points of the second electrical discharge tube are the same as those of the first electrical discharge tube shown in FIGS. 1 and 2.

Figure 6:
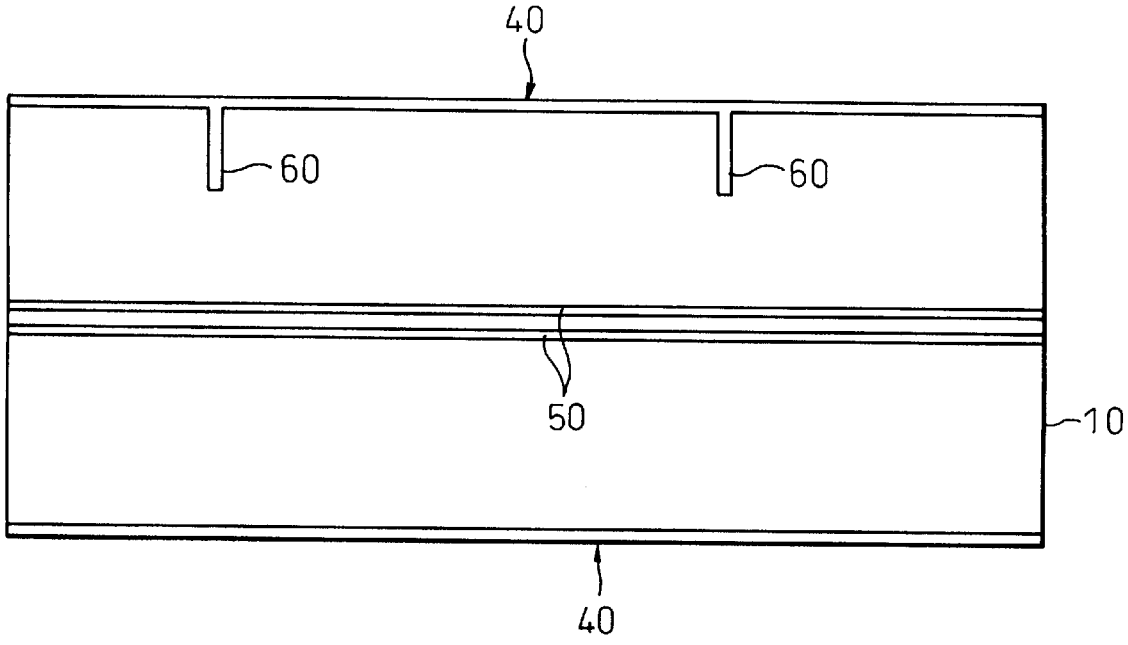
Figure 7:
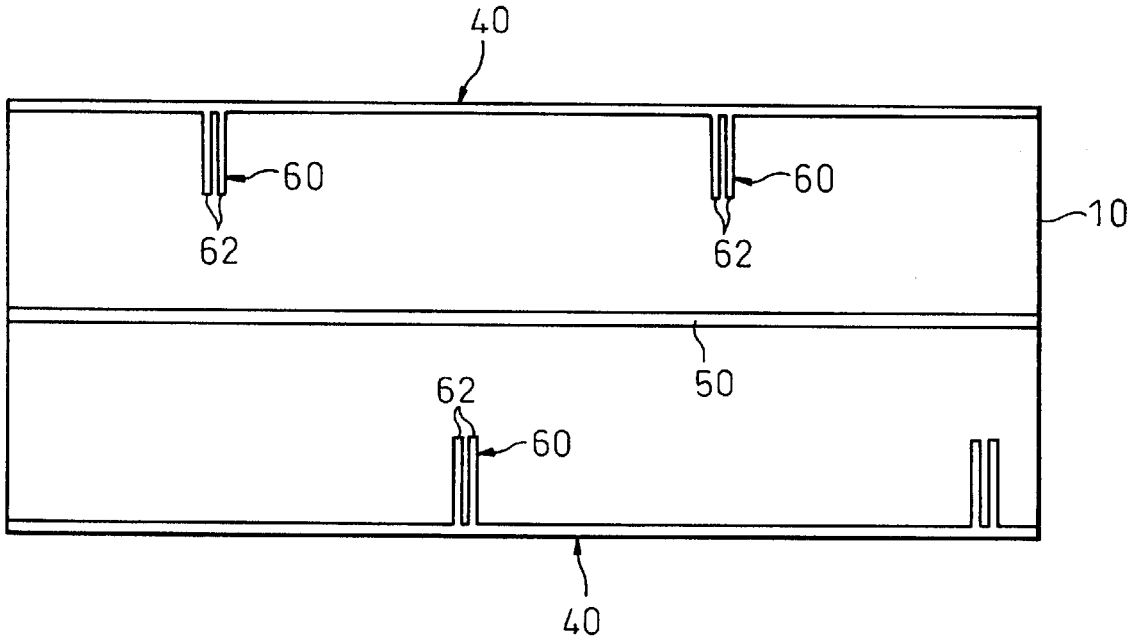
FIGS. 7 and 8 are development views respectively showing an inside wall of an airtight cylinder of the first electrical discharge tube of the present invention.
Figure 8:
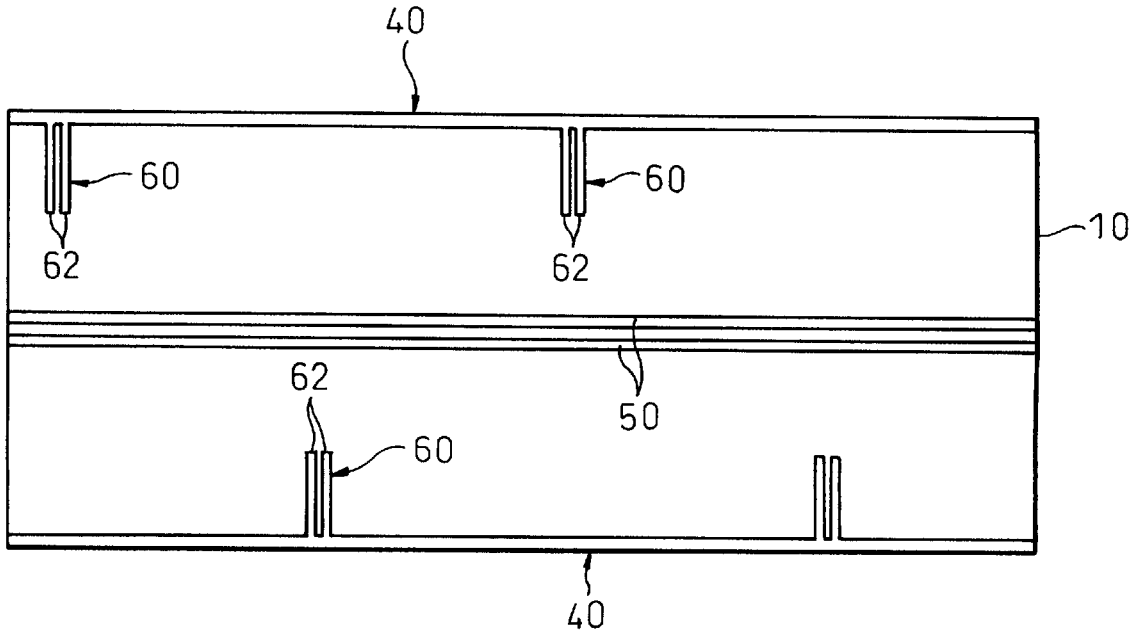
Figure 9:
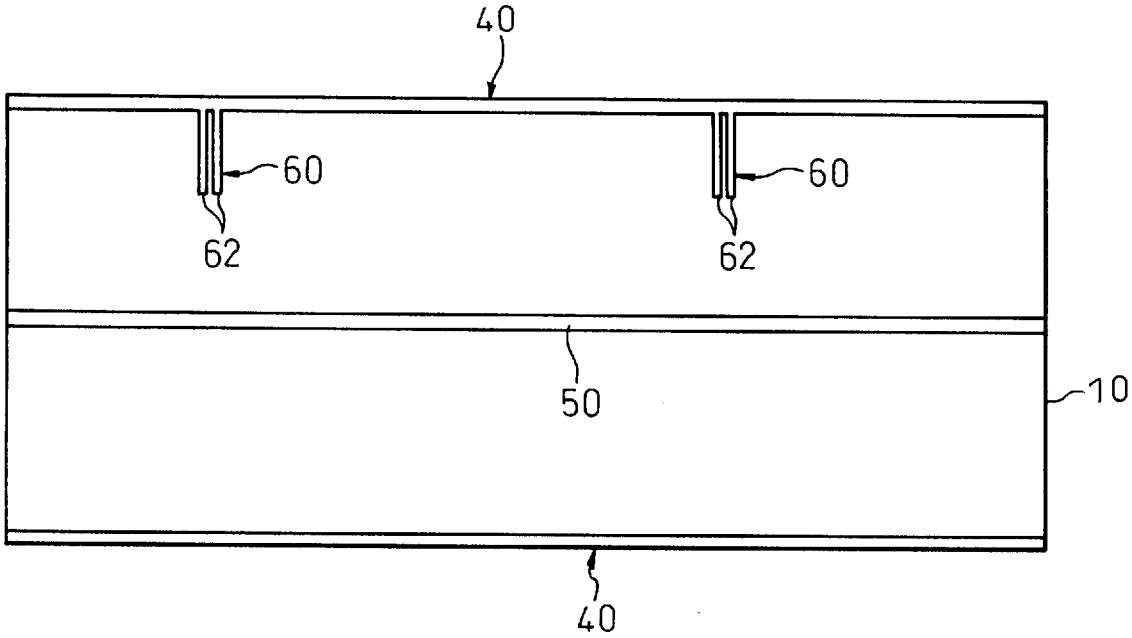
FIGS. 9 and 10 are development views respectively showing an inside wall of an airtight cylinder of the second electrical discharge tube of the present invention.
Figure 10:
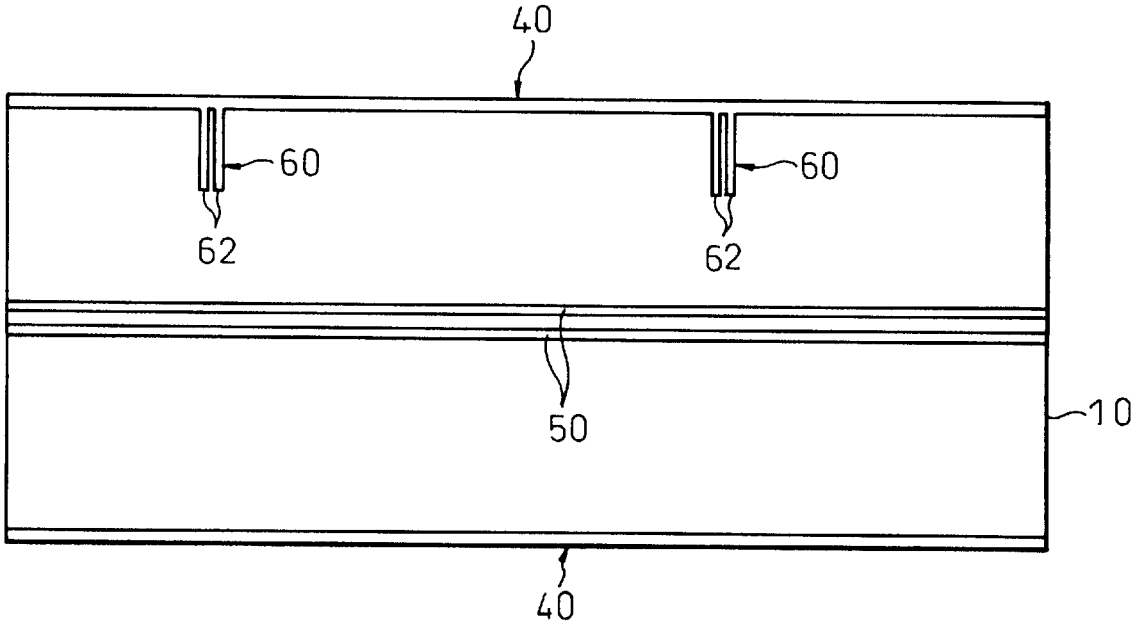

Another preferable embodiment of the second electrical discharge tube is shown in FIG. 6.

In the second electrical discharge tube shown in FIG. 2, at the center of the inside wall of the airtight cylinder 10 located between the second plane 33 including the electrical discharge face 23 and the third plane 35 including the electrical discharge face 25 of the forward end of the lower discharge electrode, which are opposed to each other at the center of the airtight cylinder 10, instead of one piece of the first electrical discharge trigger 50, a plurality of the first electrical discharge trigger wires 50 (the two electrical discharge trigger wires 50 are shown in the drawing) made of carbon, the wire width of which is 0.2 mm, are symmetrically arranged on both sides of the first plane 31 and cross the center of the electrical discharge gap formed between the electrical discharge face 23 and the electrical discharge face 25, in the traverse direction in a loop-shape at predetermined intervals while the plurality of the first electrical discharge trigger wires 50 cross the inside wall of the airtight cylinder 10 substantially parallel with the metalized face 40.

Other points of this embodiment are the same as those of the second electrical discharge tube shown in FIGS. 4 and 5.

In the first and the second electrical discharge tube shown in FIGS. 1 to 6, the first electrical discharge trigger wire 50 of the electrical discharge tube is arranged in the traverse direction perpendicular to the axis of the airtight cylinder 10 and substantially parallel with the direction of the winding of the primary side booster coil in the ballast circuit into which this electrical discharge tube is incorporated. Therefore, it is possible to prevent the generation of an electrical current caused by the electromagnetic induction of the first electrical discharge trigger wire 50 being affected by the magnetic field of the primary side booster coil. As a result, it is possible to prevent the fluctuation of the electrical potential of electrical discharge repeatedly induced being affected by the magnetic field of the primary booster coil. Also, it is possible to keep the electrical discharge starting voltage at the first time constant.

At the same time, even if the electrical discharge tube is surrounded by the resin made of dielectric material as described before, the second electrical discharge trigger wire 60 is composed in such a manner that the length of the second electrical discharge trigger wire 60 is short and substantially the same as the distance from the metalized face 40 to the fourth plane 37 or the fifth plane 39 located close to it. Therefore, electrons for the use of creeping corona discharge can be effectively converged upon the second electrical discharge trigger wires 60 without being affected by the resin. As a result, the electrical discharge starting voltage generated at the first time by the second electrical discharge trigger wire 60 can be stabilized without being raised.

Since the forward end of the second electrical discharge trigger wire 60 is arranged substantially on the same face as the fourth plane 37 or the fifth plane 39, it is possible to prevent the forward end of the second electrical discharge trigger wire 60 from being located too distant from the electrical discharge face 23 or the electrical discharge face 25. Further, it is possible to prevent the electrical discharge starting voltage generated at the first time from being raised.

Since the first electrical discharge trigger wire 50 is formed into a loop-shape in the traverse direction at the center of the inside wall of the airtight cylinder 10, it is possible to keep constant the distance from the first electrical discharge trigger wire 50 to the second electrical discharge trigger wire 60, which is formed on the inside wall of the airtight cylinder 10 close to it. When the first electrical discharge trigger wire 50 and second electrical discharge trigger wire 60, which are separated by a constant distance, are used, electrical discharges of the electrical discharge tube induced at a predetermined electrical potential can be repeatedly and stably conducted.

When the electrical discharge tube is manufactured, it is enough that the first electrical discharge trigger wire 50 is serially formed into a loop-shape in the traverse direction at the center of the inside wall of the airtight cylinder 10. Therefore, the first electrical discharge trigger wire 50 can be easily and quickly formed without taking time and labor.

In the first electrical discharge tube, the second electrical discharge trigger wires 60, which are formed on the upper inside wall and the lower inside wall of the airtight cylinder 10 and adjacent to each other, are arranged in the traverse direction at predetermined intervals. Accordingly, it is possible to prevent the occurrence of electrical shorts caused by spatters, which are created in the process of electrical discharge from the electrical discharge face 23, the electrical discharge face 25, the first trigger wire 50 and the second rigger wire 60, and which adhere to the center of the inside wall of the airtight cylinder 10, between the second electrical discharge trigger wires 60 disposed adjacent to each other.

In the second electrical discharge tube, the inside wall portion of the airtight cylinder 10 composed of insulating material, in which no trigger wires exist, is widely arranged between the first electrical discharge trigger wire 50, which is formed at the center of the inside wall of the airtight cylinder 10, and the metalized face 40 on the positive electrode side formed on the lower end face of the airtight cylinder 10. Therefore, even when spatters created in the case of electrical discharges from the electrical discharge face 23 of the forward end of the upper electrical discharge electrode, the electrical discharge face 25 of the forward end of the lower electrical discharge electrode, the first trigger wire 50 and the second trigger wire 60 adhere to a portion on the inside wall between the first electrical discharge trigger wire 50 and the metalized face 40 on the positive electrode side, it is possible to prevent the electrical insulation between the first electrical discharge trigger wire 50 and the metalized face 40 on the positive electrode side from deteriorating.

In the second electrical discharge tube, the aging treatment to activate the electrical discharge faces 23, 25 can be conducted only when an over-voltage of DC is impressed between the upper electrical discharge electrode 22 on the negative electrode side and the lower electrical discharge electrode 24 on the positive electrode side only in one direction. Therefore, the process of the aging treatment, which is complicated, can be reduced by half.

Figure 3:
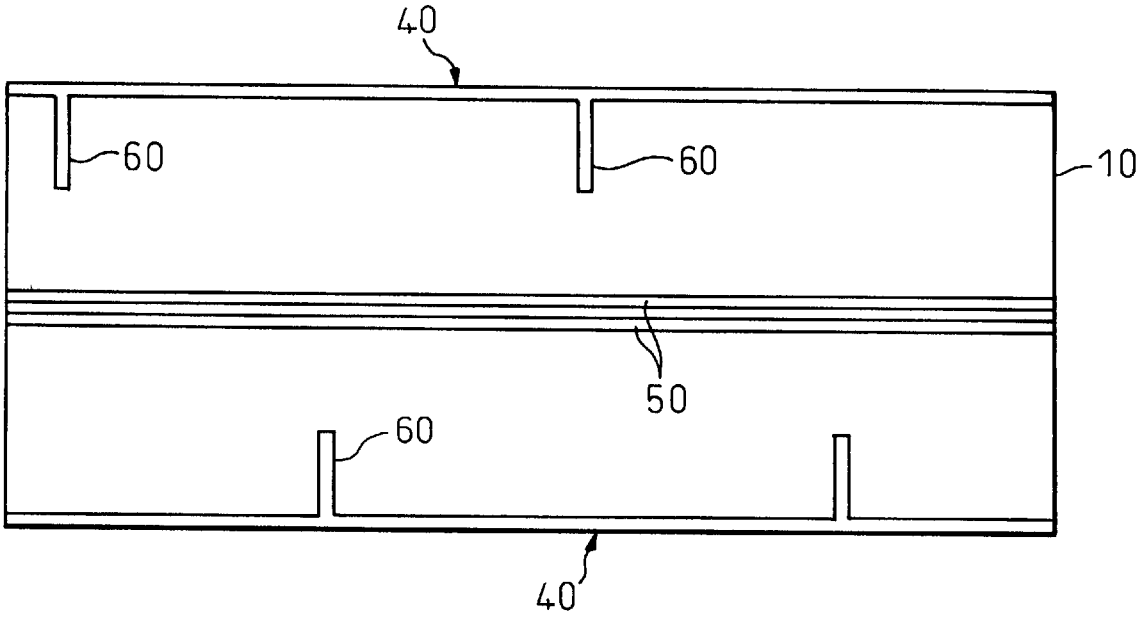

In the first and the second electrical discharge tube shown in FIGS. 3 and 6, a plurality of pieces of the first electrical discharge trigger wires 50 are arranged at the center of the inside wall of the airtight cylinder 10 located between the second plane 33 and the third plane 35. Therefore, the plurality of pieces of the first electrical discharge trigger wires 50 are not protruded from the upper portion of the inside wall of the airtight cylinder 10 outside the second plane 33 and the lower portion of the inside wall of the airtight cylinder 10 outside the third plane 35 but formed at the center of the inside wall of the airtight cylinder 10 located inside it. Therefore, it is possible to prevent the plurality of pieces of the first electrical discharge trigger wires 50 from coming too close to the upper electrical discharge electrode 22 and the lower electrical discharge electrode 24. Accordingly, it is possible to prevent the electrical potential of electrical discharge from decreasing to lower than a predetermined value.

Referring to FIGS. 7 to 10, another preferable embodiment of the first electrical discharge tube and also another preferable embodiment of the second electrical discharge tube will be explained below.

In the first and the second electrical discharge tube, the second electrical discharge trigger wires 60 are composed of a plurality of pieces of the second electrical discharge trigger wires 62 which are arranged close to each other substantially in parallel with each other.

Other points of this embodiment are the same as those of the first and the second electrical discharge tube shown in FIGS. 1 to 6.

In the first and the second electrical discharge tube, when electrical discharges are repeatedly induced, the electrical discharge starting voltage at the first time can be stabilized at a constant voltage, over a long period of time, without raising it.

The above effect is remarkable especially when the electrical discharge tube is used for the ballast circuit and placed at a dark place surrounded by resin and electrical discharges are repeatedly induced in gas in which electrons in the space of the airtight cylinder 10 of the electrical discharge tube are not excited. In this case, the electrical discharge starting voltage at the first time can be kept constant and the life of the electrical discharge tube can be greatly extended, for the reason described before.

Figure 11:
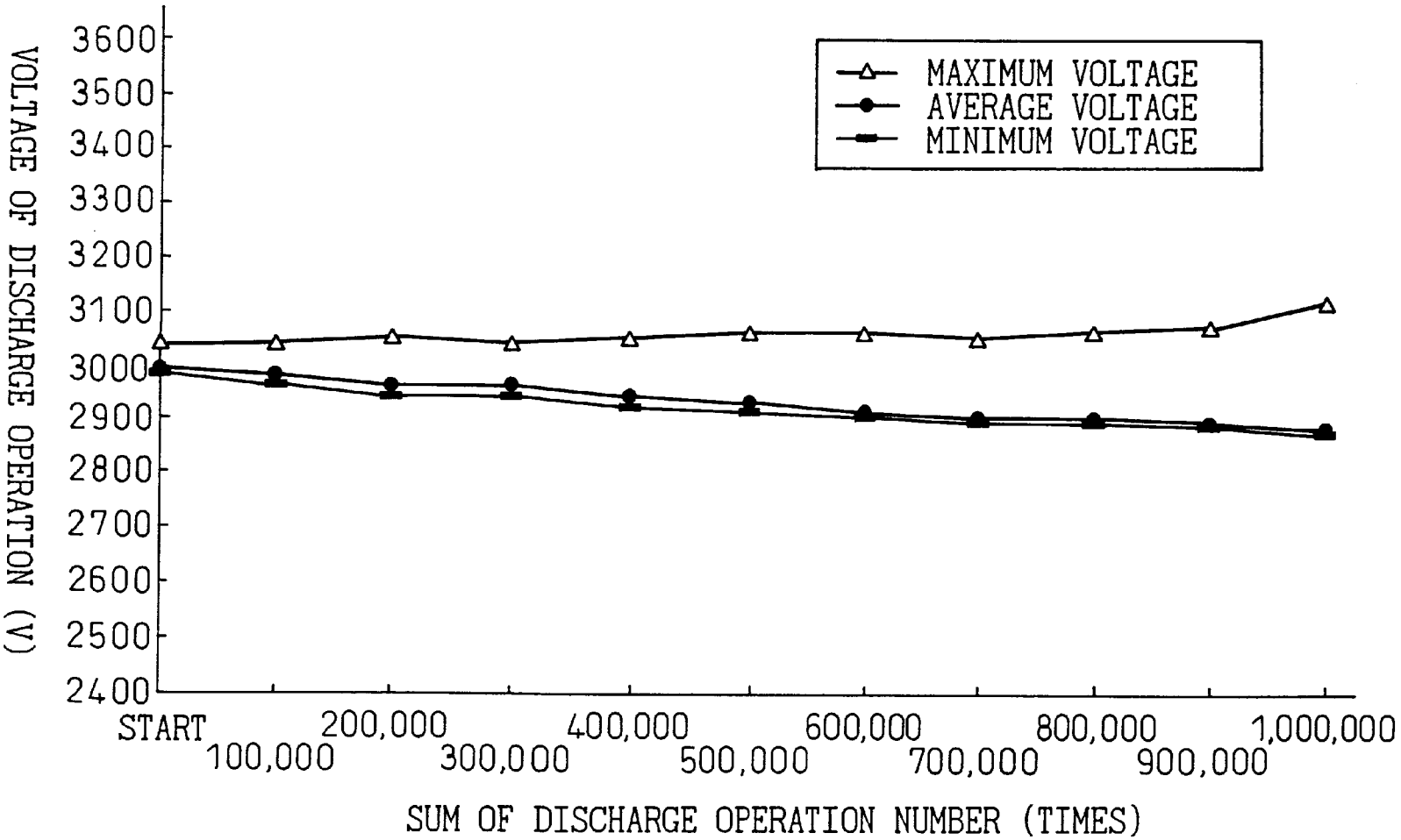
FIGS. 11 to 13 are diagrams respectively showing a result of a life test the first electrical discharge tube of the present invention.

FIG. 11 is a graph showing the result of a life test of the first electrical discharge tube conducted at a dark place, wherein the first electrical discharge tube is composed in such a manner that one piece of the first electrical discharge trigger wire 50 is provided at the center of the inside wall of the airtight cylinder 10, and the second electrical discharge trigger wires 60, in which two pieces of the sub-second electrical discharge trigger wires 62 are respectively arranged close to each other, and substantially parallel with each other, on the upper inside wall and the lower inside wall of the airtight cylinder 10, are shifted from each other one by one in the traverse direction by a distance corresponding to half of the circumferential length of the inside wall of the airtight cylinder 10.

Figure 12:
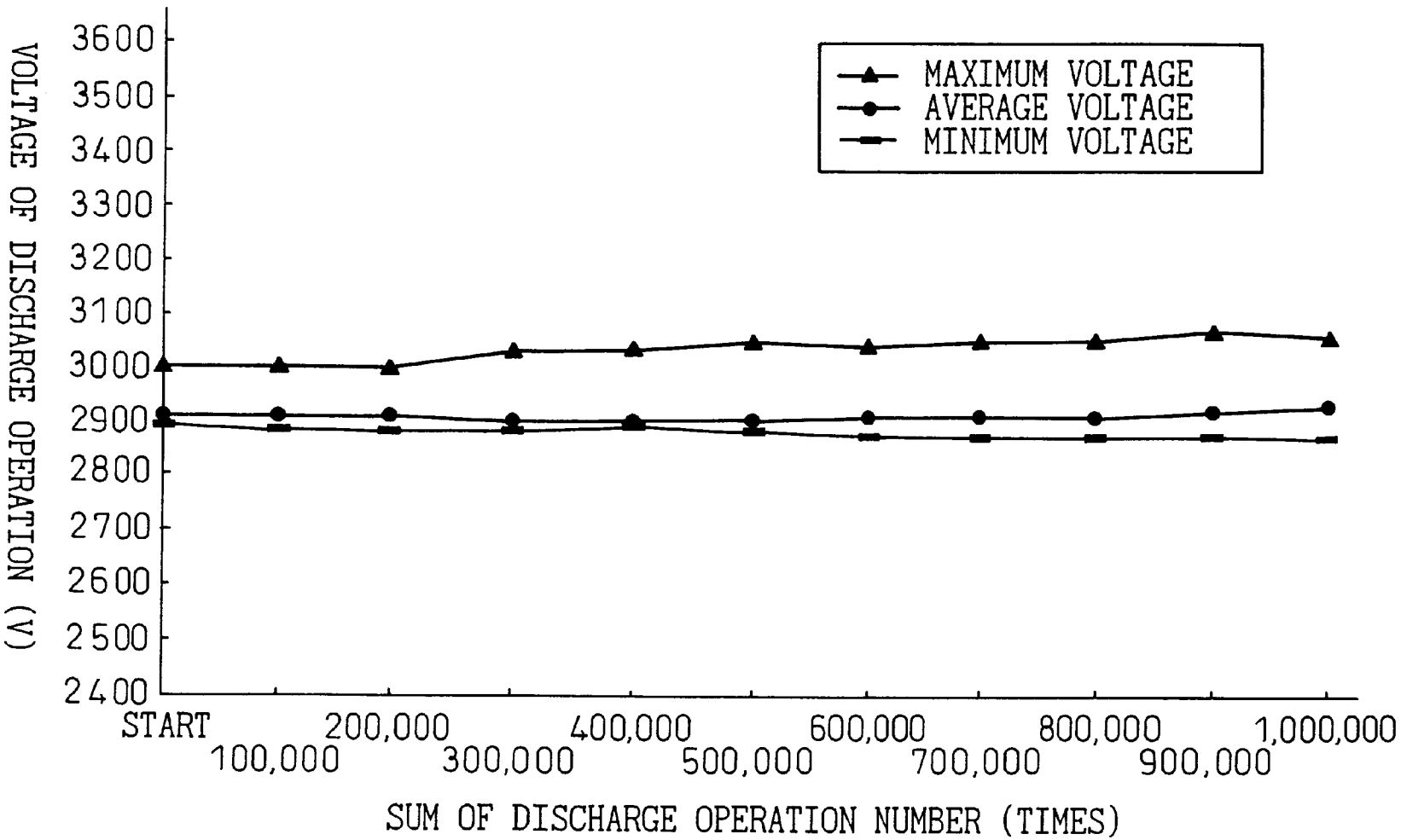

FIG. 12 is a graph showing the result of a life test of the first electrical discharge tube conducted at a dark place, wherein the first electrical discharge tube is composed in such a manner that one piece of the first electrical discharge trigger wire 50 is provided at the center of the inside wall of the airtight cylinder 10, and three pieces of the sub-second electrical discharge trigger wires 62 are respectively arranged close to each other substantially in parallel with each other on the upper inside wall and the lower inside wall, and the second electrical discharge trigger wires 60 are shifted from each other in the traverse direction by a distance corresponding to half of the circumferential length of the inside wall of the airtight cylinder 10.

Figure 13:
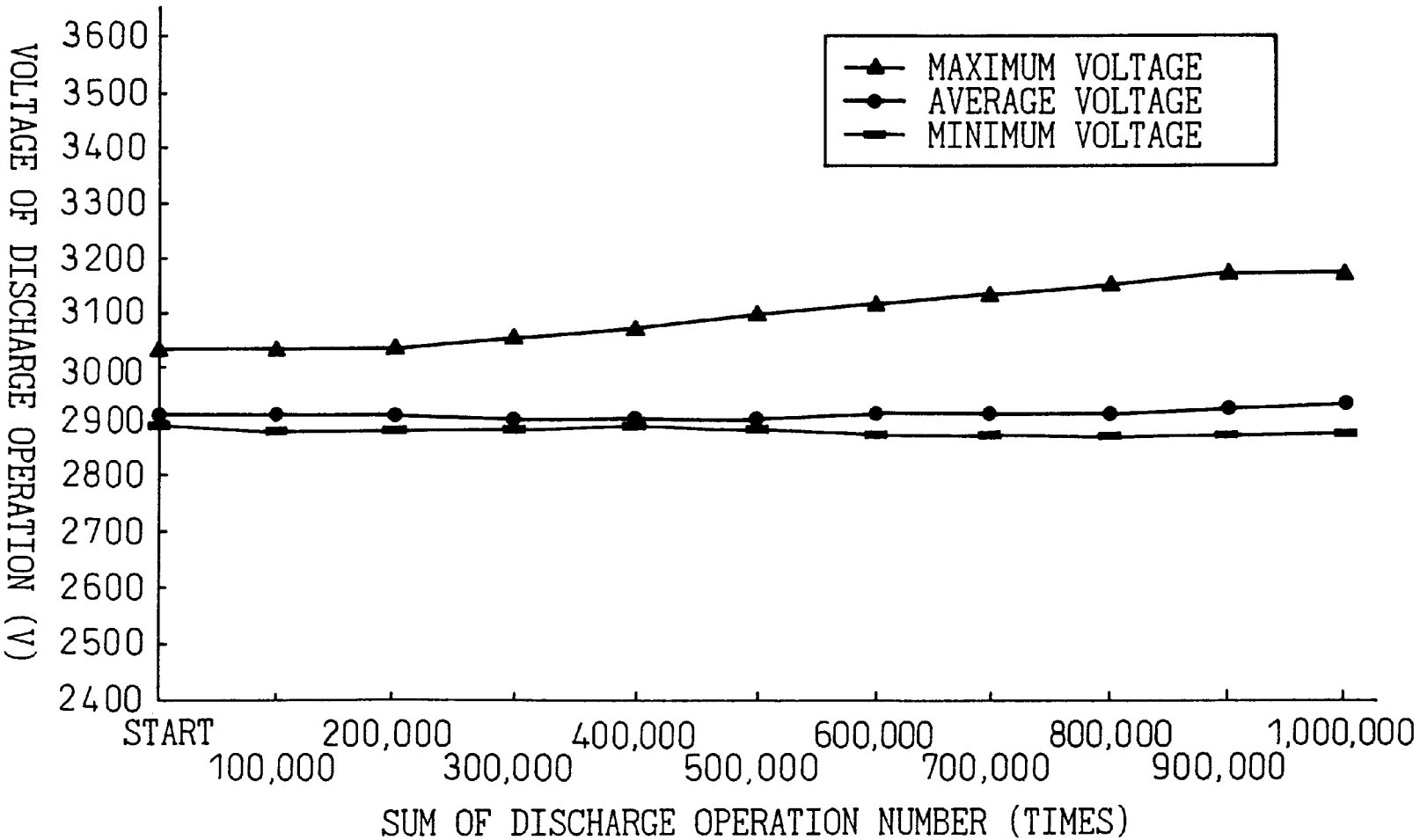

On the other hand, FIG. 13 is a graph showing the result of a life test of the first electrical discharge tube conducted at a dark place, wherein the first electrical discharge tube is composed in such a manner that one piece of the first electrical discharge trigger wire 50 is provided at the center of the inside wall of the airtight cylinder 10, and one piece of the sub-second electrical discharge trigger wire 60 is arranged on each of the upper inside wall and the lower inside wall, and the second electrical discharge trigger wire 60 is shifted from each other in the traverse direction by a distance corresponding to half of the circumferential length of the inside wall of the airtight cylinder 10.

As can be seen in FIG. 11, when the second electrical discharge trigger wires 60 are composed of two pieces of the sub-second electrical discharge trigger wires 62, it is possible to stably and repeatedly induce electrical discharges of the electrical discharge operation voltage of 3,000 V about 900,000 times.

As shown in FIG. 12, when the second electrical discharge trigger wires 60 are composed of three pieces trigger wires, it is possible to repeatedly and stably induce electrical discharges at the voltage of about 2,900 V not less than 1,000,000 times over a long period of time.

On the other hand, when the second electrical discharge trigger wires 60 are composed of one piece of trigger wire, it is only possible to induce electrical discharges, at the voltage of about 2,900 V, 200,000 times.

Figure 14:
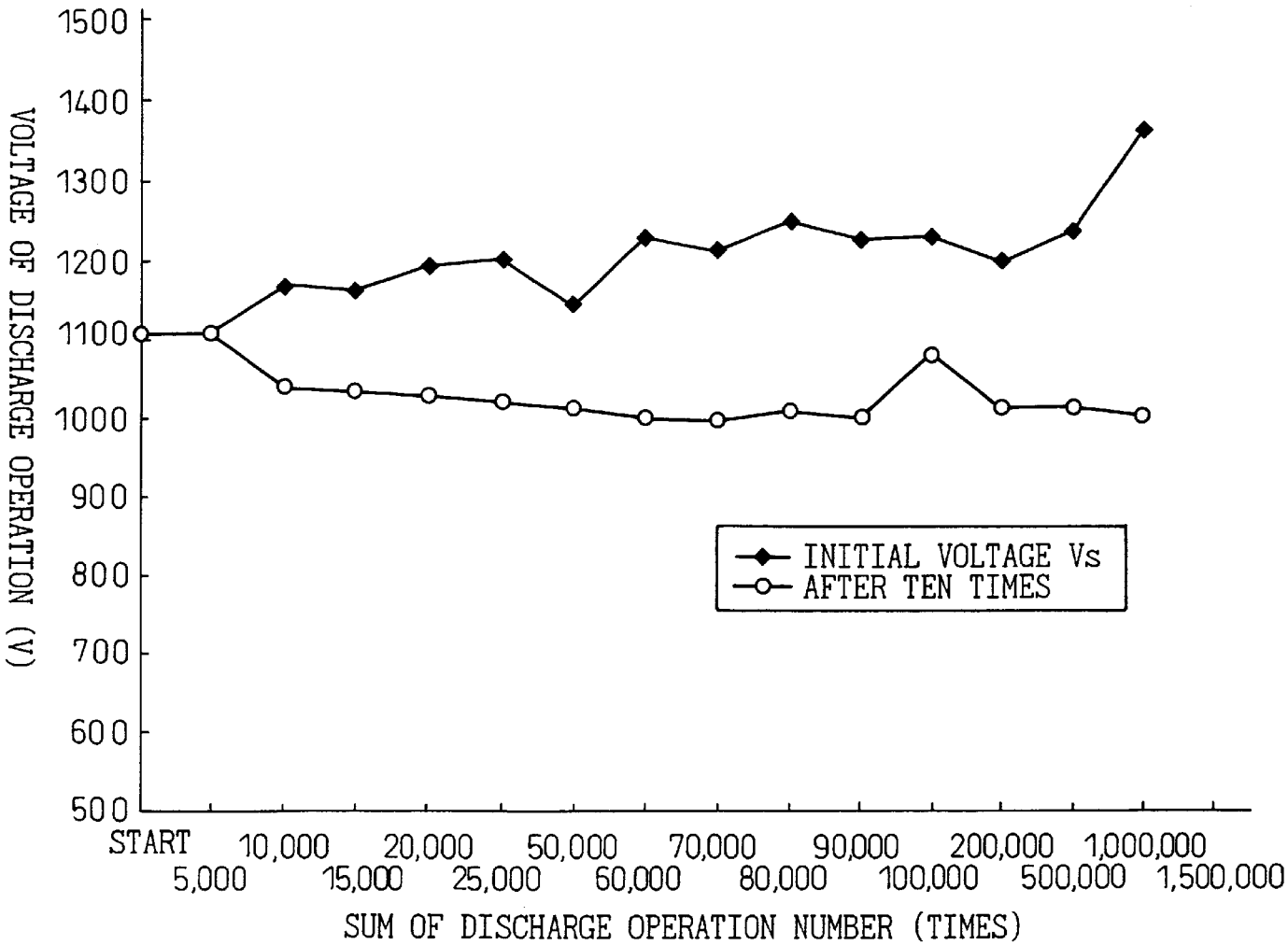
FIGS. 14 to 16 are diagrams respectively showing a result of a life test the second electrical discharge tube of the present invention.

FIG. 14 is a graph showing the result of a life test of the second electrical discharge tube conducted at a dark place, wherein the second electrical discharge tube is composed in such a manner that one piece of the first electrical discharge trigger wire 50 is provided at the center of the inside wall of the airtight cylinder 10, and two pieces of the second electrical discharge trigger wires 60, in which two pieces of the sub-second electrical discharge trigger wires 62 are respectively arranged close to each other and substantially in parallel with each other on the upper inside wall of the airtight cylinder 10, are shifted from each other in the traverse direction by a distance corresponding to half of the circumferential length of the inside wall of the airtight cylinder 10.

Figure 15:
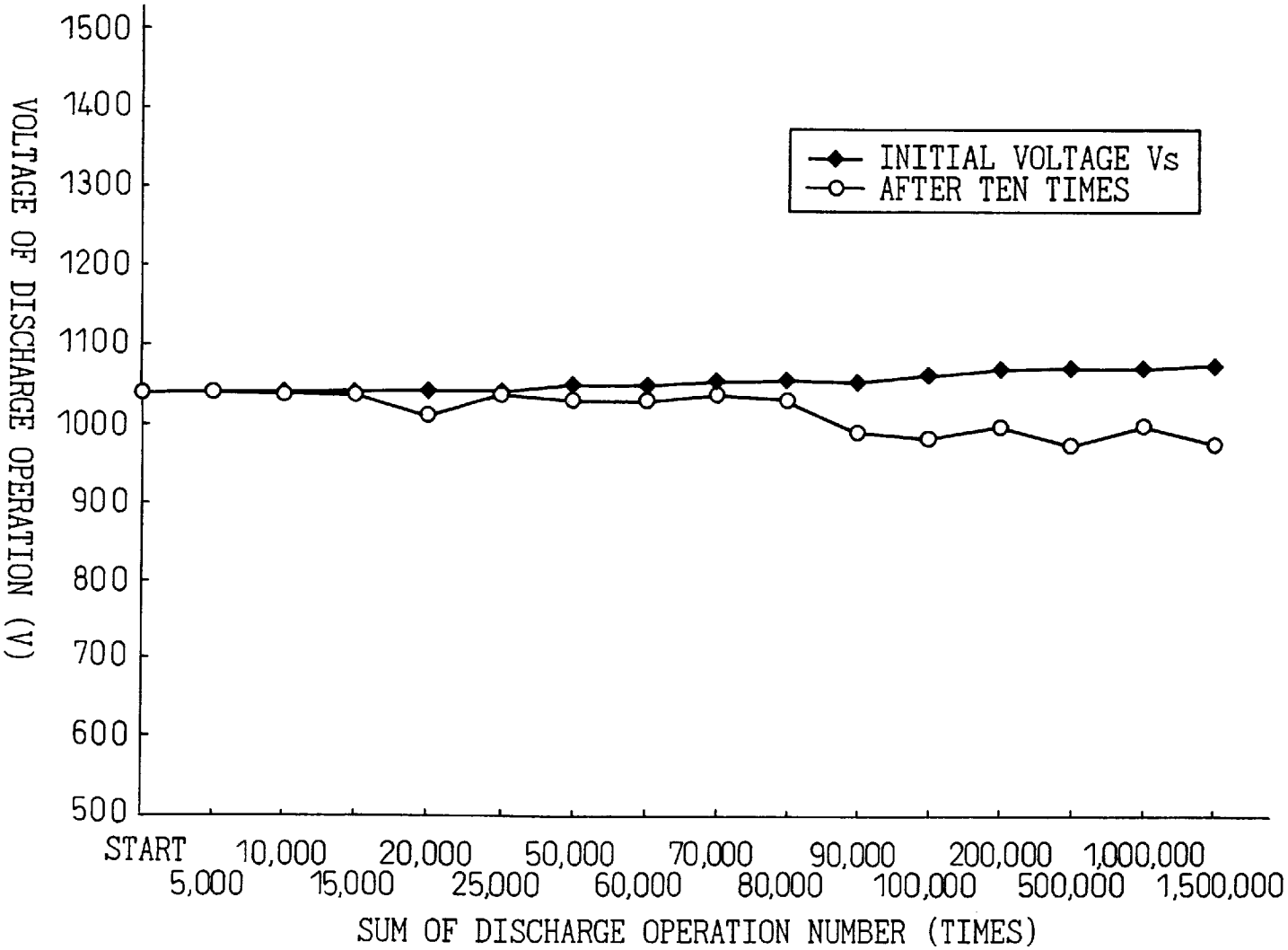

FIG. 15 is a graph showing the result of a life test of the second electrical discharge tube conducted at a dark place, wherein the second electrical discharge tube is composed in such a manner that one piece of the first electrical discharge trigger wire 50 is provided at the center of the inside wall of the airtight cylinder 10, and two pieces of the second electrical discharge trigger wires 60, in which three pieces of the sub-second electrical discharge trigger wires 62 are respectively arranged close to each other and substantially in parallel with each other on the upper inside wall of the airtight cylinder 10, are shifted from each other in the traverse direction by a distance corresponding to half of the circumferential length of the inside wall of the airtight cylinder 10.

Figure 16:
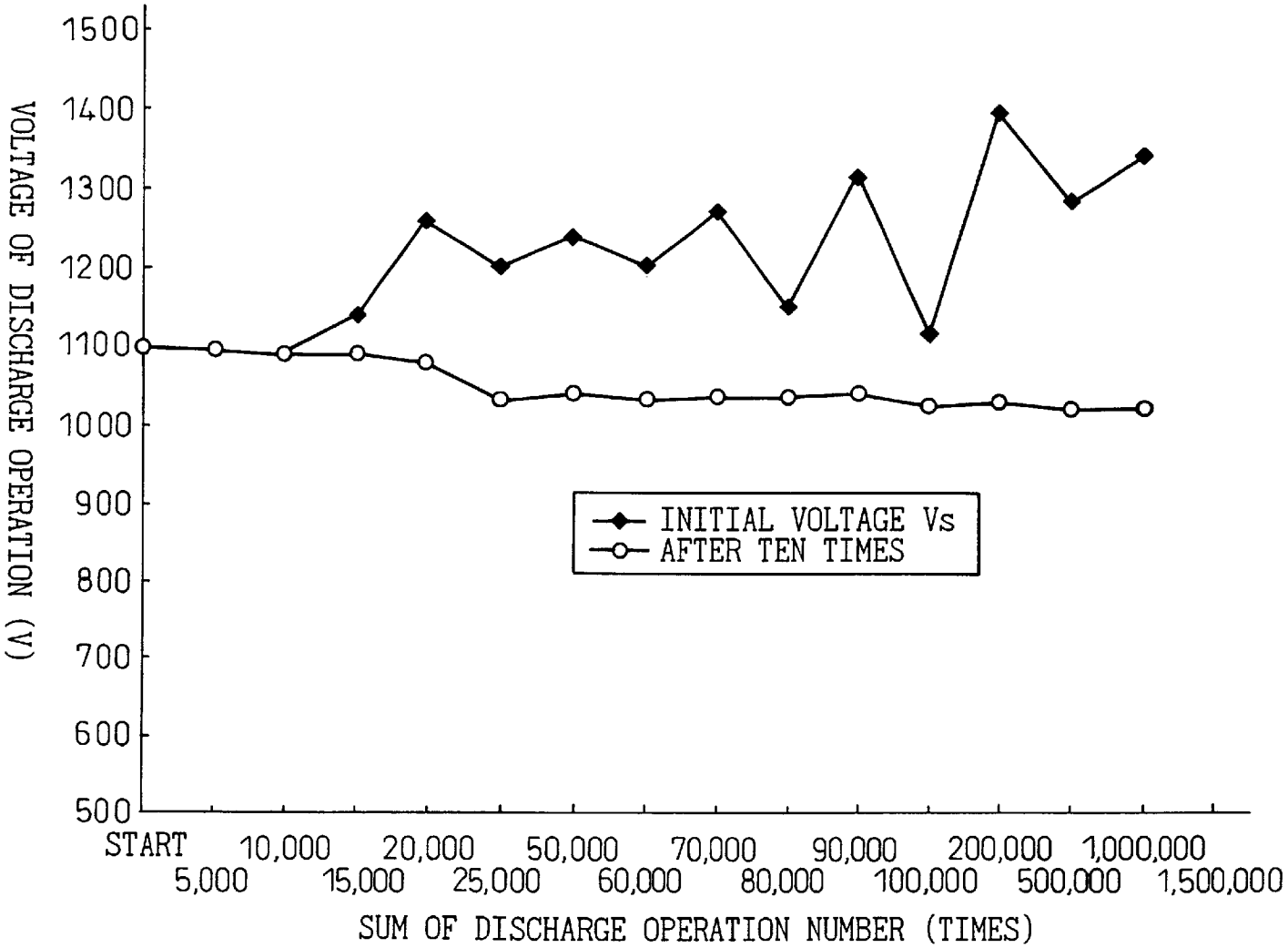
Figure 17:
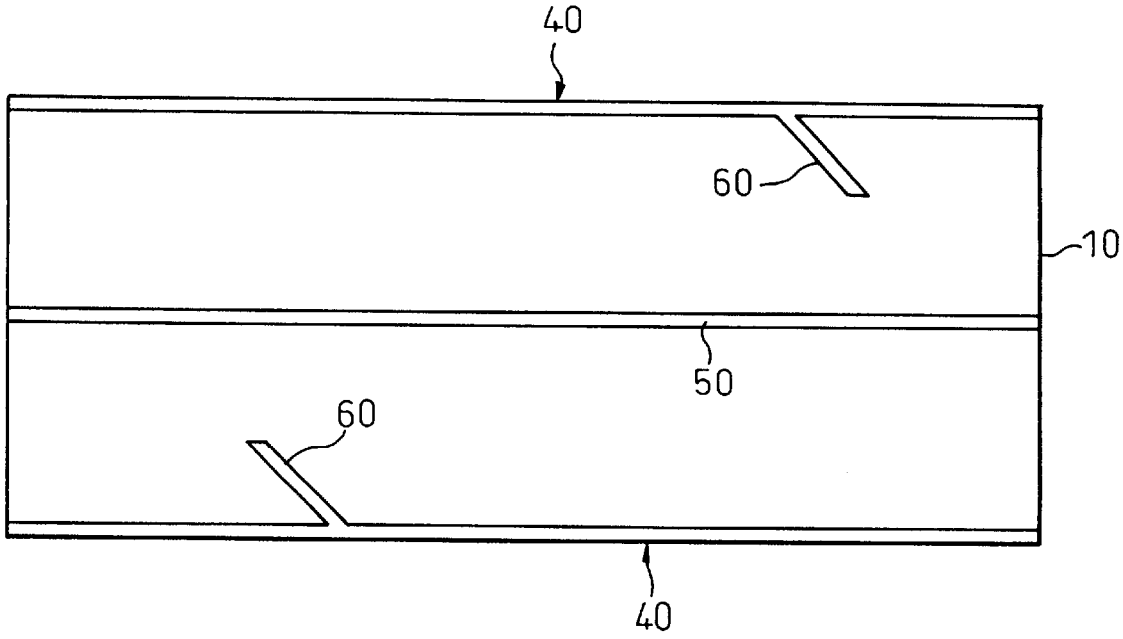
FIGS. 17 to 20 are development views respectively showing an inside wall of an airtight cylinder of the first electrical discharge tube of the present invention.
Figure 18:
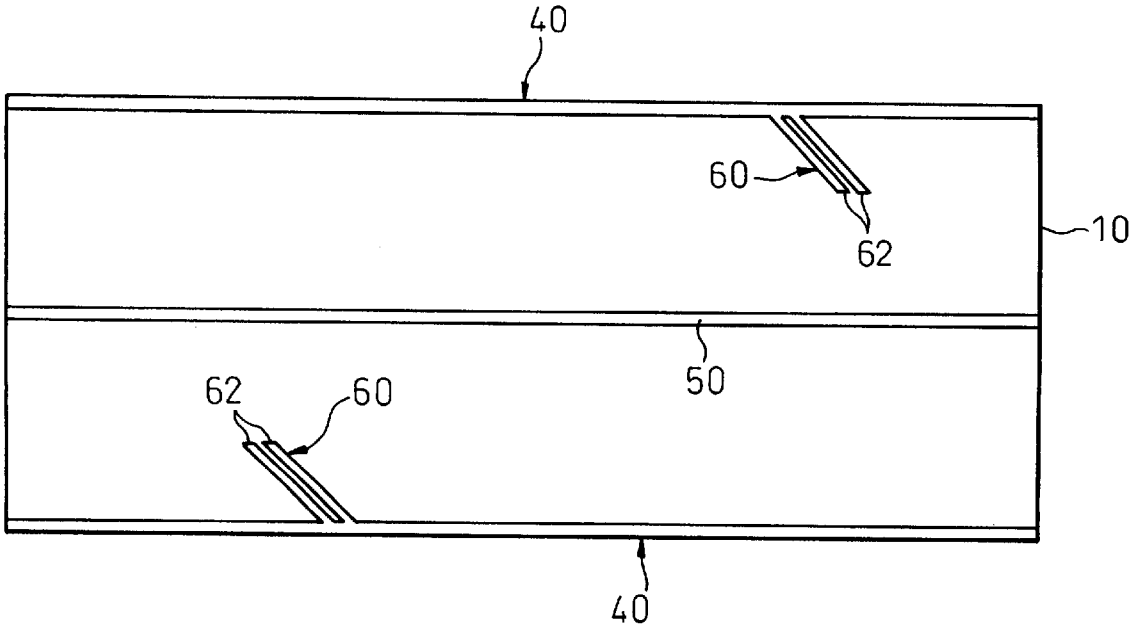
Figure 19:
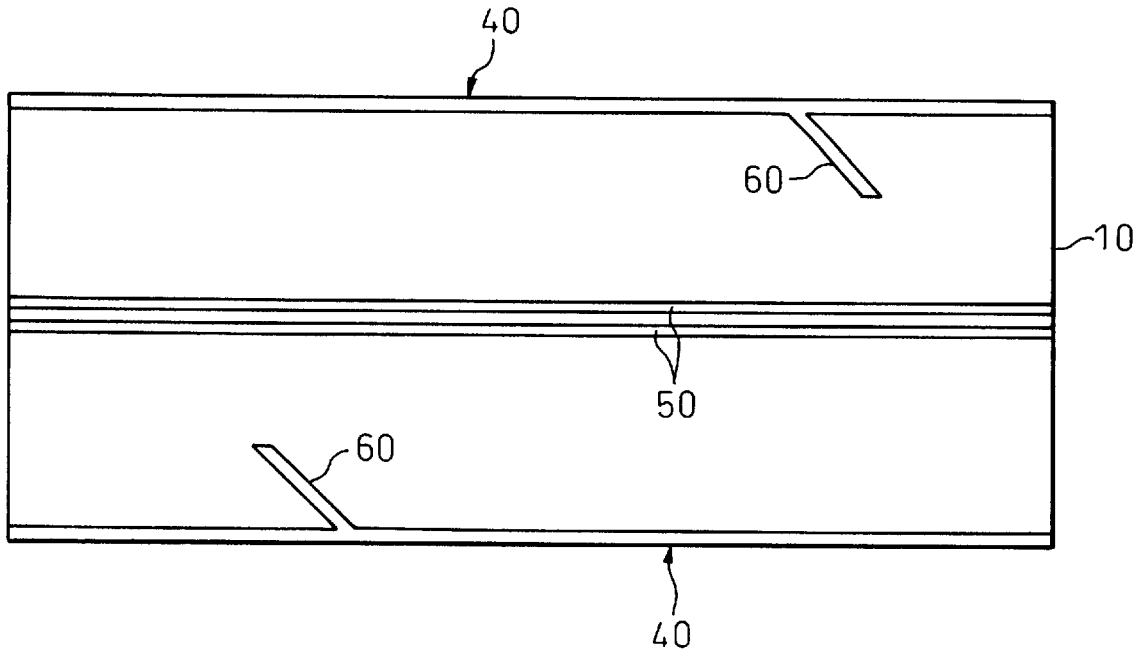
Figure 20:
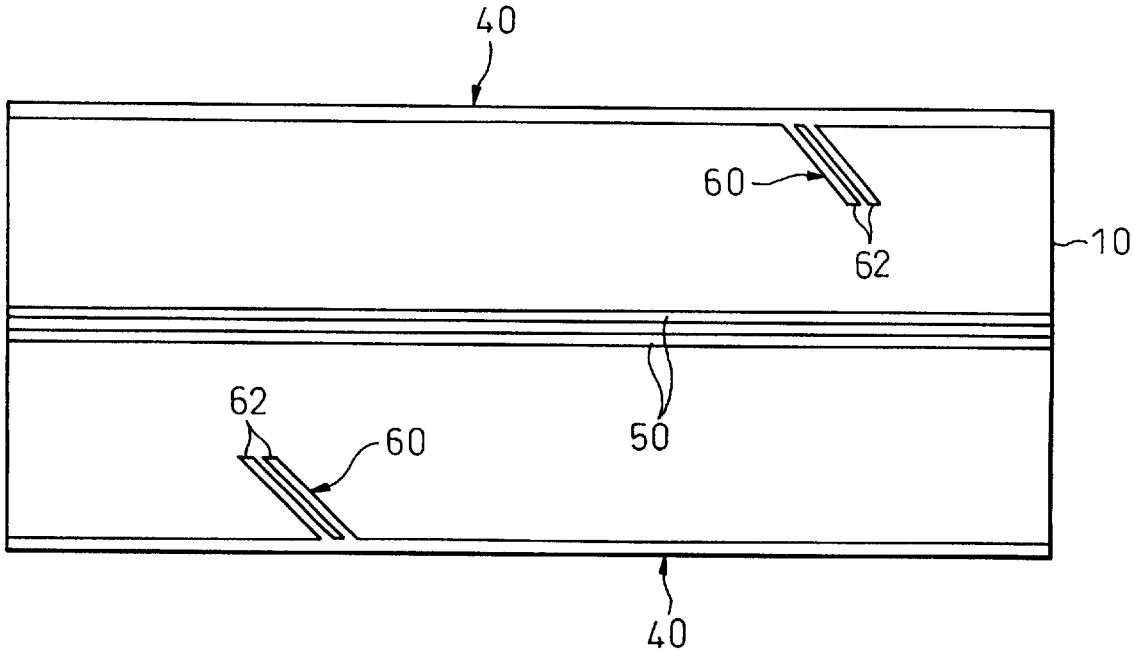
Figure 21:
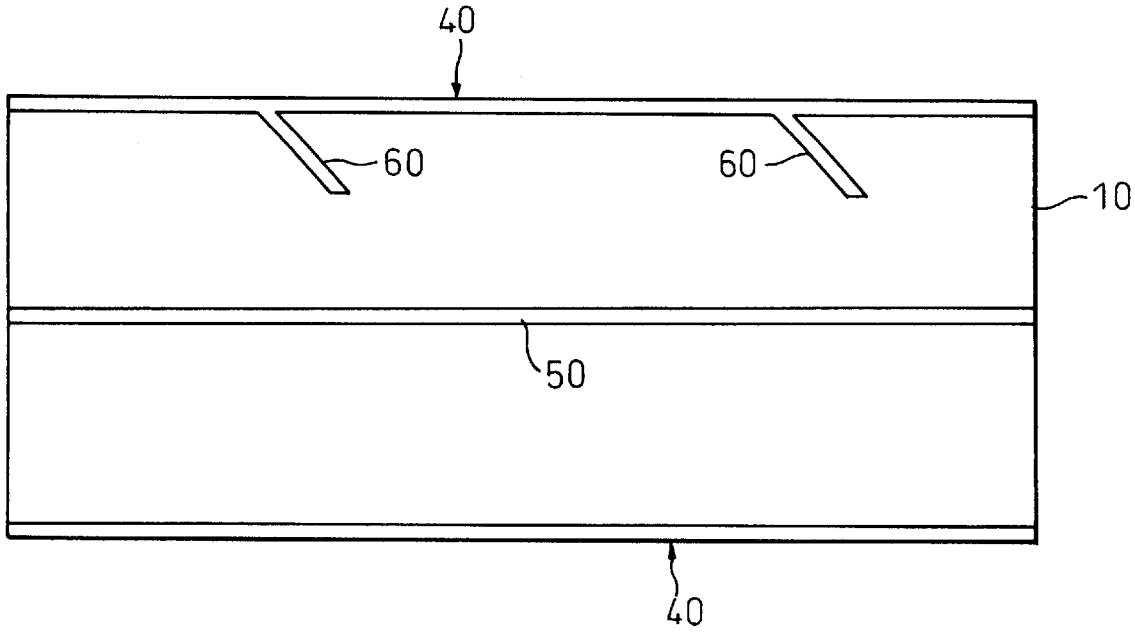
FIGS. 21 to 24 are development views respectively showing an inside wall of an airtight cylinder of the second electrical discharge tube of the present invention.
Figure 22:
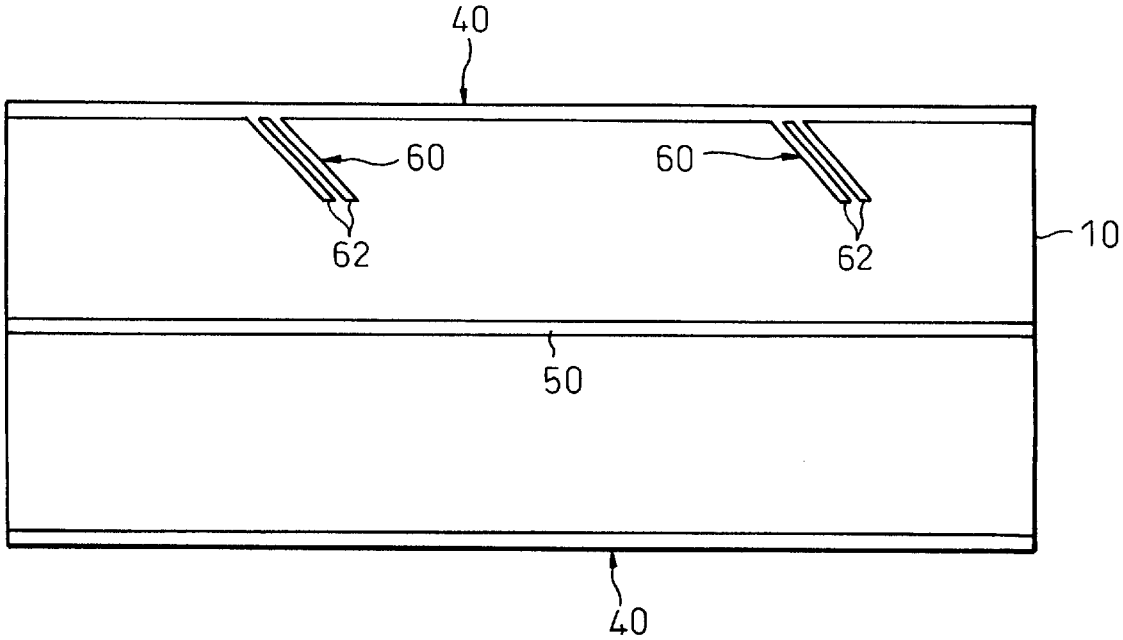
Figure 23:
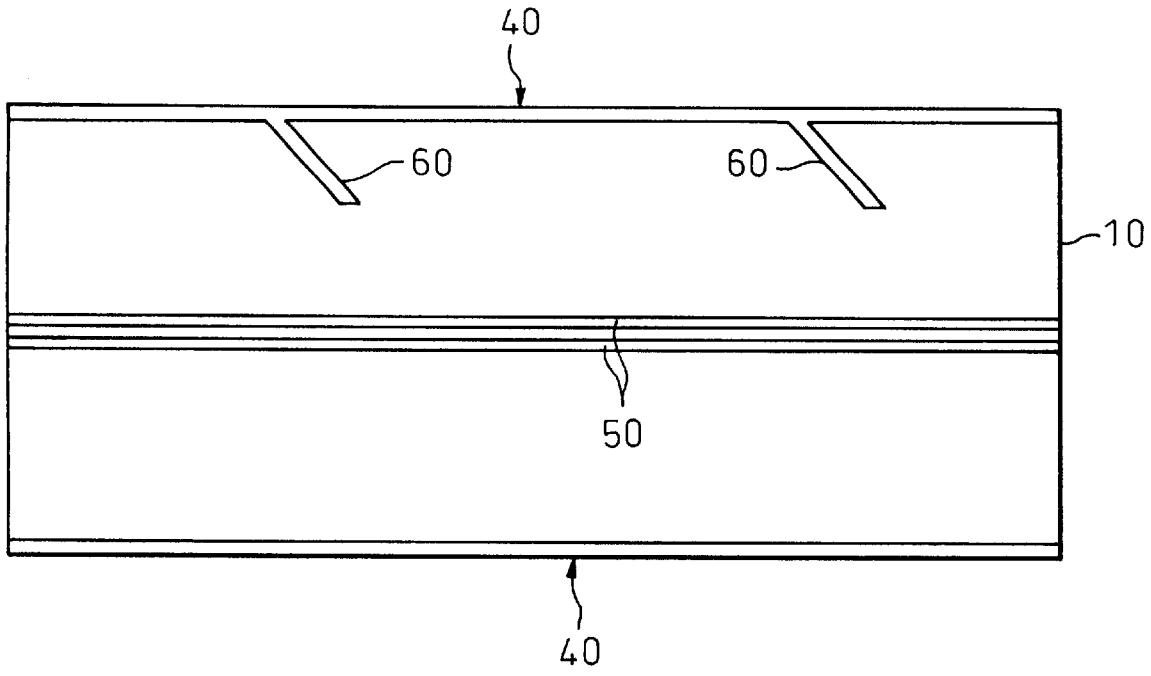
Figure 24:
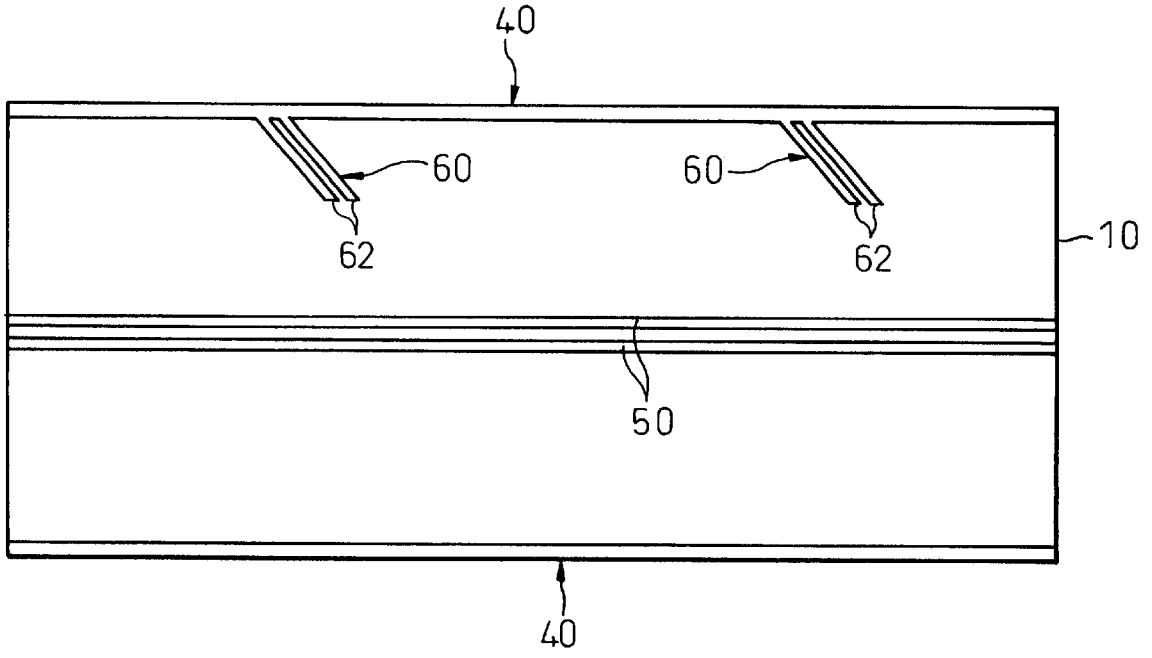
Figure 25:
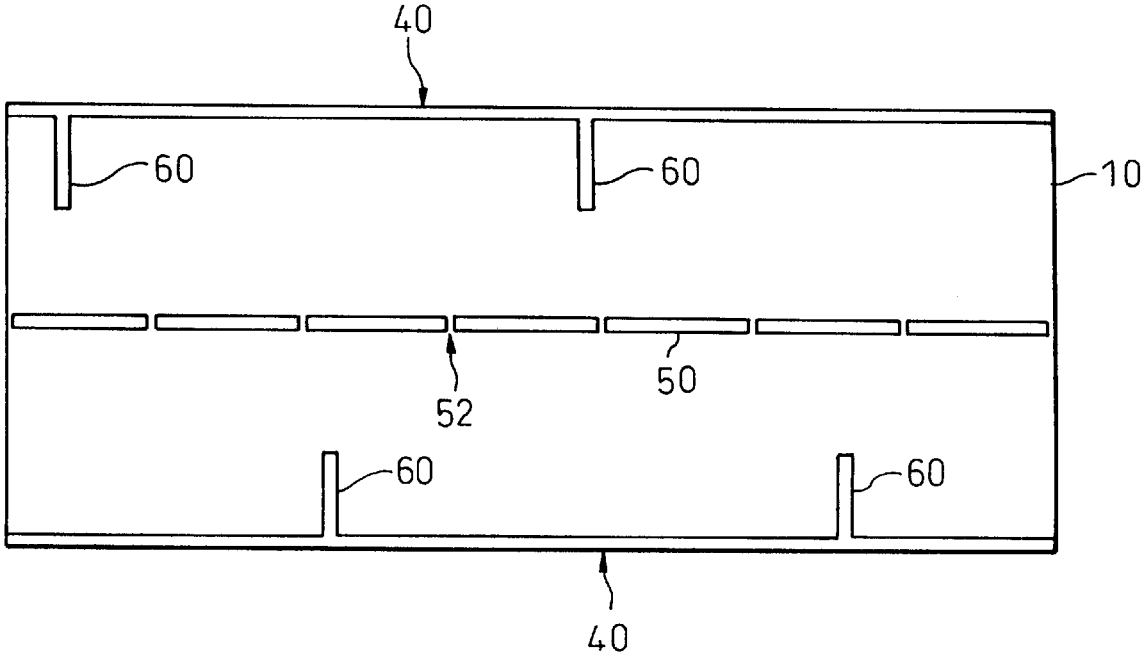
FIGS. 25 to 28 are development views respectively showing an inside wall of an airtight cylinder of the first electrical discharge tube of the present invention.
Figure 26:
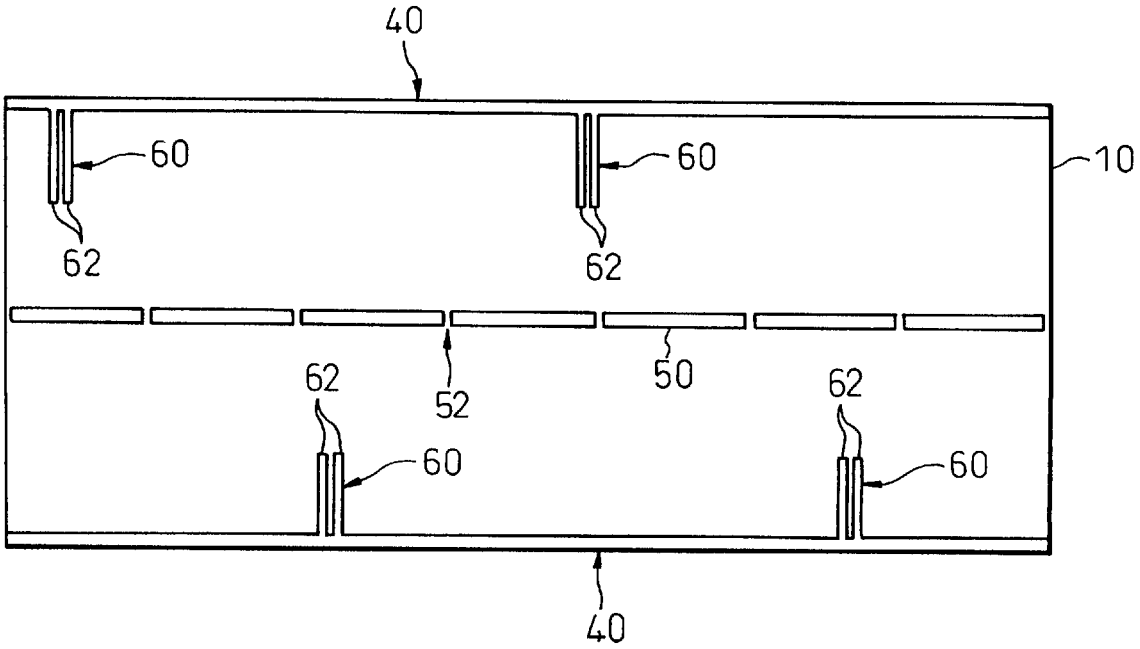
Figure 27:
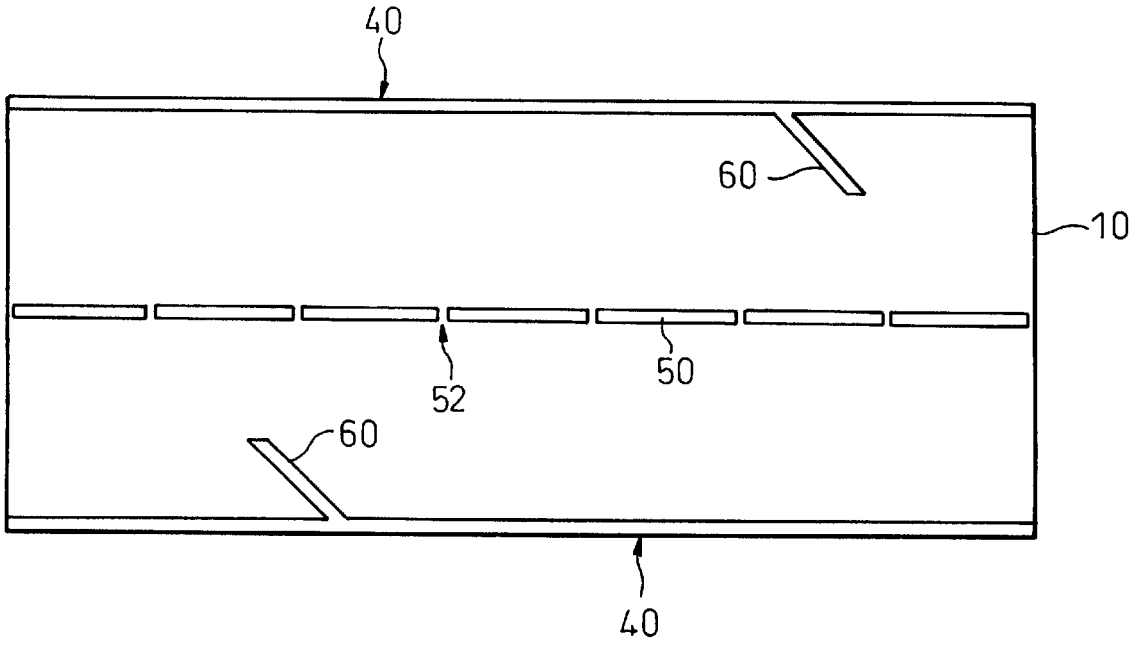
Figure 28:
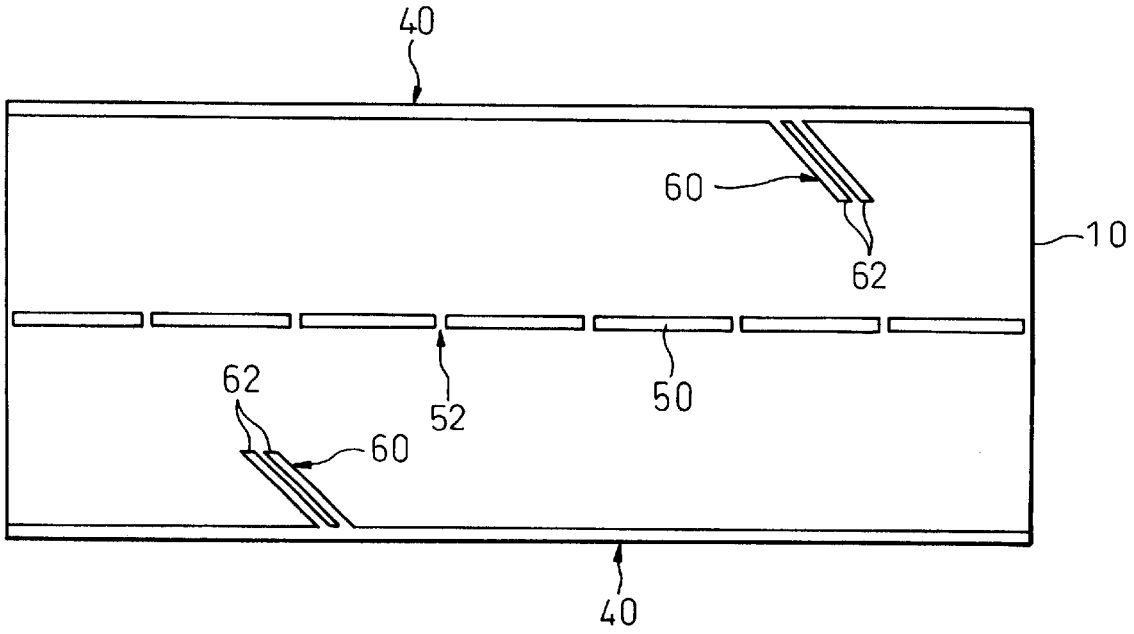
Figure 29:
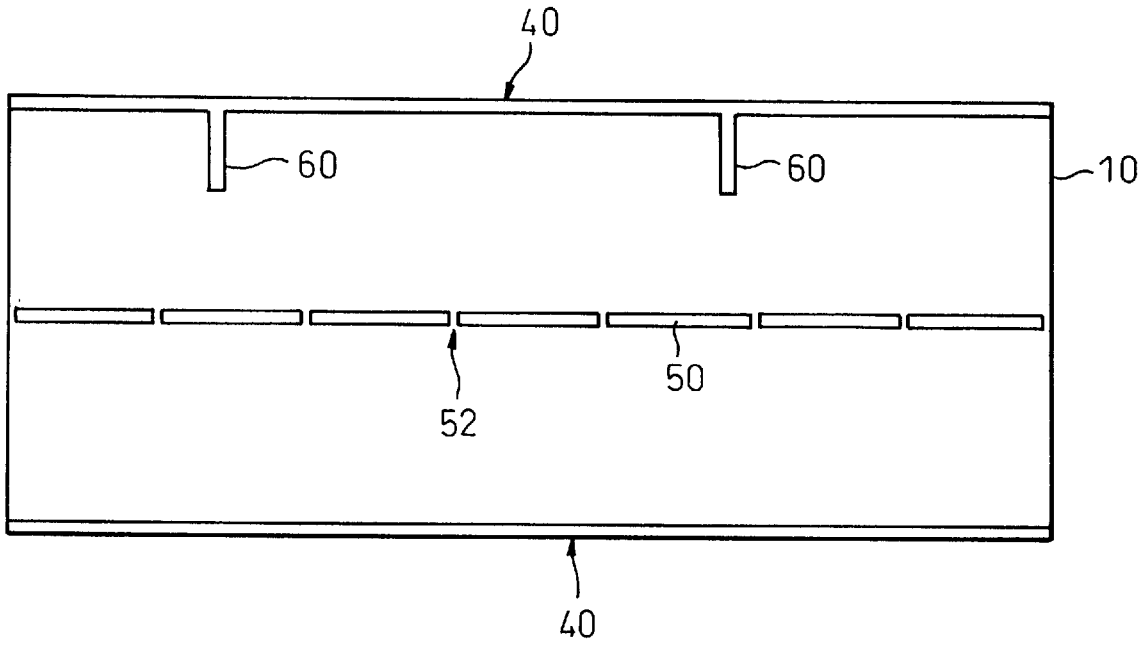
FIGS. 29 to 32 are development views respectively showing an inside wall of an airtight cylinder of the second electrical discharge tube of the present invention.
Figure 30:
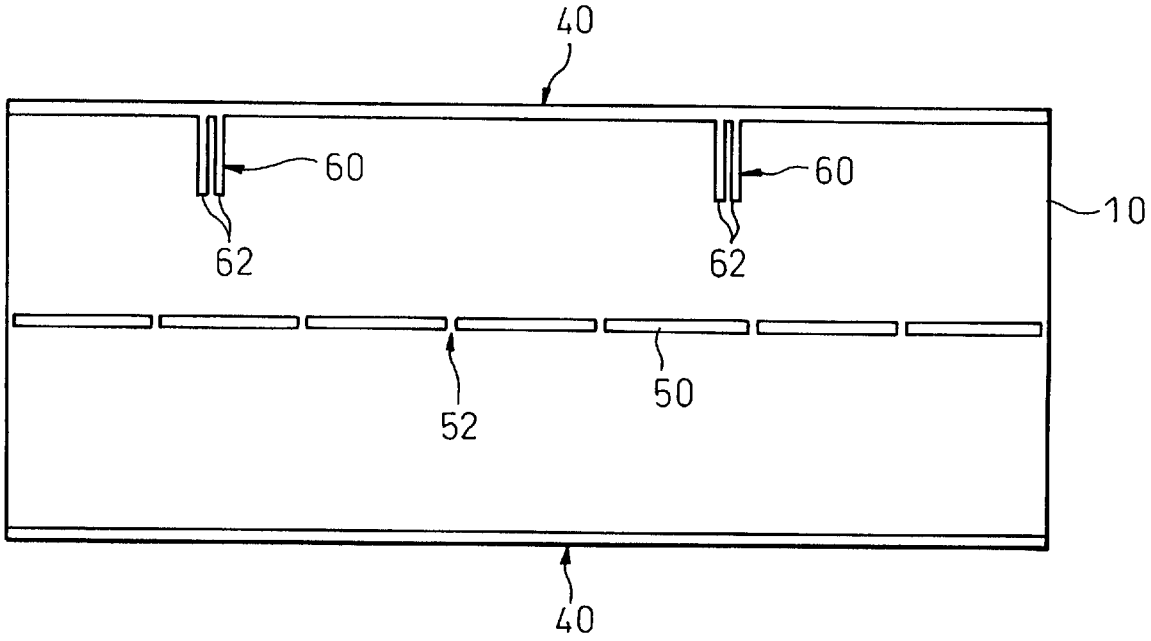
Figure 31:
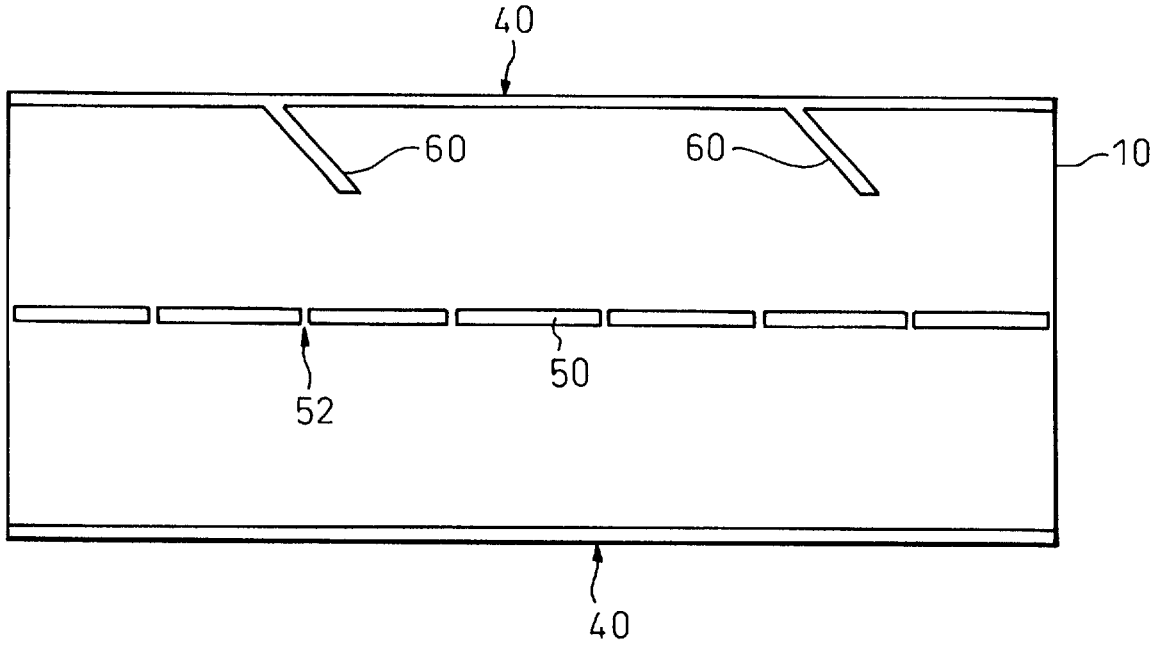
Figure 32:
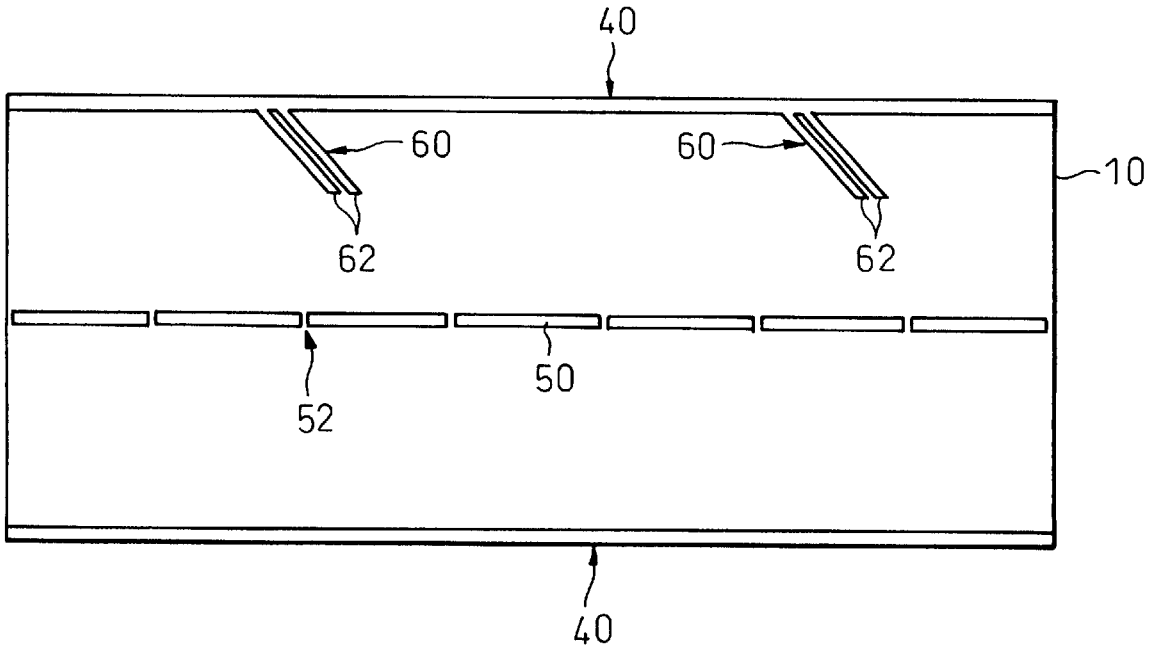

On the other hand, FIG. 16 is a graph showing the result of a life test of the second electrical discharge tube conducted at a dark place, wherein the second electrical discharge tube is composed in such a manner that one piece of the first electrical discharge trigger wire 50 is provided at the center of the inside wall of the airtight cylinder 10, and two pieces of the second electrical discharge trigger wires 60, in which one piece of the sub-second electrical discharge trigger wire 60 is arranged on the upper inside wall of the airtight cylinder 10, are shifted from each other in the traverse direction by a distance corresponding to half of the circumferential length of the inside wall of the airtight cylinder 10.

As shown in FIG. 14, when the second electrical discharge trigger wire 60 is composed of two pieces of the sub-second electrical discharge trigger wires 62, it is possible to repeatedly and stably induce electrical discharges, at a voltage of about 1,100 V, about 50,000 times.

As shown in FIG. 15, when the second electrical discharge trigger wire 60 is composed of three pieces of the sub-second electrical discharge trigger wires 62, it is possible to repeatedly and stably induce electrical discharges, at the voltage of about 1,050 V, about 1,500,000 times.

On the other hand, as shown in FIG. 16, when the second electrical discharge trigger wire 60 is composed of only one piece of the second sub-electrical discharge trigger wire 62, it is only possible to repeatedly induce electrical discharges, at the voltage of about 1,100 V, 20,000 times.

In the electrical discharge tube used for the life tests shown in FIGS. 11 to 16, the outer diameter of the airtight cylinder 10 was about 8 mm, and the gap in which the sub-electrical discharge trigger wire 62 is opposed to the side edge was 0.2 mm.

In the electrical discharge tube used for the life tests, it was found that the gap in which two or three pieces of the sub-electrical discharge trigger wires 62 composing the second electrical discharge trigger wire 60 were opposed to the side edge was preferably 0.1 to 0.25 mm.

When the gap in which two or three pieces of the sub-electrical discharge trigger wires 62 composing the second electrical discharge trigger wire 60 were opposed to the side edge was smaller than 0.1 mm, the function of the two or three pieces of the sub-electrical discharge trigger wires 62 becomes the same as the function of the second electrical discharge trigger wire 60 composed of one piece of the sub-electrical discharge trigger wire 62. In the case of the second electrical discharge trigger wire 60 having two or three pieces of the sub-second electrical discharge trigger wires 62 which are arranged too close to each other, the electrical discharge starting voltage at the first time of the electrical discharge tube at a dark place was gradually raised in its early stages.

When the gap between two or three pieces of the sub-second electrical discharge trigger wires 62, which compose the second electrical discharge trigger wire 60, and the side edge opposed to them was larger than 0.25 mm, the function of the two or three pieces of the sub-second electrical discharge trigger wires 62 becomes the same as the function of the second electrical discharge trigger wire 60 composed of one piece of the sub-second electrical discharge trigger wire 62. In the case of the second electrical discharge trigger wire 60 in which two or three pieces of the sub-second electrical discharge trigger wires are arranged too distant from each other, the electrical discharge starting voltage at the first time of the electrical discharge tube at a dark place was gradually raised in its early stages.

Referring to FIGS. 17 to 24, other preferable embodiments of the first and second electrical discharge tube of the present invention will be explained below.

In the first electrical discharge tubes shown in FIGS. 17 to 20, on the upper inside wall of the airtight cylinder 10, one piece or a plurality of pieces of the second electrical discharge trigger wires 60 (in the case shown in the drawings, one piece of the second electrical discharge trigger wire 60 is shown) composed of a carbon wire, the width of which is about 0.5 mm, are arranged in such a manner that the second electrical discharge trigger wires 60 are inclined with respect to the axis of the airtight cylinder 10 in the same direction or alternately in the opposite direction being raised in the upward and downward direction.

This second electrical discharge trigger wire 60 is composed of two pieces of the sub-electrical discharge trigger wires 62 or one piece of the second electrical discharge trigger wire 60. The forward end of the second electrical discharge trigger wire 60 is located substantially on the same plane as the fourth plane 37, and the backward end of the second electrical discharge trigger wire 60 is serially connected with the metalized face 40 formed on the upper end face of the airtight cylinder 10 located close to it.

On the lower inside wall of the airtight cylinder 10, one piece of or a plurality of pieces of the second electrical discharge trigger wires 60 (in the case shown in the drawings, one piece of the second electrical discharge trigger wire 60 is shown) composed of a carbon wire, the width of which is about 0.5 mm, are arranged in such a manner that the second electrical discharge trigger wires 60 are inclined with respect to the axis of the airtight cylinder 10 in the same direction or alternately in the opposite direction being raised in the upward and downward direction.

This second electrical discharge trigger wire 60 is composed of two pieces of the sub-electrical discharge trigger wires 62 or one piece of the second electrical discharge trigger wire 60. The forward end of the second electrical discharge trigger wire 60 is located substantially on the same plane as the fifth plane 39, and the backward end of the second electrical discharge trigger wire 60 is serially connected with the metalized face 40 formed on the lower end face of the airtight cylinder 10 located close to it.

In the second electrical discharge tube shown in FIGS. 21 to 24, on the upper inside wall of the airtight cylinder 10 corresponding to the negative electrode side, not less than two pieces of the second electrical discharge trigger wires 60 (in the case shown in the drawings, two pieces of the second electrical discharge trigger wires 60 are shown) composed of a carbon wire, the width of which is about 0.5 mm, are arranged in such a manner that the second electrical discharge trigger wires 60 are inclined with respect to the axis of the airtight cylinder 10 in the same direction or alternately in the opposite direction by being raised in the upward and downward direction.

This second electrical discharge trigger wire 60 is composed of two pieces of the sub-electrical discharge trigger wires 62 or one piece of the second electrical discharge trigger wire 60. The forward end of the second electrical discharge trigger wire 60 is located substantially on the same plane as the fourth plane 37, and the backward end of the second electrical discharge trigger wire 60 is serially connected with the metalized face 40 formed on the upper end face of the airtight cylinder 10 located close to it.

Other points of the electrical discharge tube are the same as those of the first and the second electrical discharge tube shown in FIGS. 1 to 10, and the function thereof is the same as the functions of the first and the second electrical discharge tube shown in FIGS. 1 to 10 except for the following points.

In the electrical discharge tube described above, the second electrical discharge trigger wire 60 is inclined with respect to the axis of the airtight cylinder 10, so that the second electrical discharge trigger wire 60 is formed in an oblique direction which is close to the direction of the winding of the primary booster coil of the ballast circuit or the igniter circuit. Therefore, it is possible to prevent an electrical current from being generated in a plurality of pieces of the second electrical discharge trigger wires 60 by the effect of electromagnetic induction being affected by the magnetic field of the primary side booster coil. Further, it is possible to prevent the electrical discharge starting voltage at the first time from being unstabilized being affected by the electrical current.

According to the experiment, it is preferable that the second electrical discharge trigger wire 60 is inclined with respect to the axis of the airtight cylinder 10 by not less than 45°. In this case, it is possible to appropriately prevent an electrical current, which is generated by the magnetic field of the primary side booster coil, from being generated in the second electrical discharge trigger wire 60. This was confirmed by an experiment made by the present inventors.

At the same time, since the second electrical discharge trigger wire 60 is inclined with respect to the axis of the airtight cylinder 10, even if the electrical discharge tube is surrounded by a resin made of dielectric material, electrical discharges can be induced in the second electrical discharge trigger wire 60, so that electrons of the corona discharge can be effectively converged. Therefore, it is possible to prevent the electrical discharge starting voltage, at the first time, from being raised by using the second electrical discharge trigger wire 60.

In the electrical discharge tube shown in FIGS. 1 to 10, it is preferable that one or a plurality of break portions 52 are formed in the middle portion of the first electrical discharge trigger wire 50, as shown in FIGS. 25 to 32.

Even in this case, it is possible to effectively converge electrons used for creeping corona discharge upon the first electrical discharge trigger wire 50 having the break portions 52 so that electrical discharges can be induced. By using the first electrical discharge trigger wire 50 having the break portions 52, electrical discharges at a predetermined electrical potential can be repeatedly and stably induced, and the electrical discharge starting voltage at the first time can be stabilized.

However, it is preferable that a total of the lengths of the break portions 52 of the first electrical discharge trigger wire 50 is smaller than the electrical discharge gap distance.

The reason is described as follows and was confirmed by experiments made by the present inventors. When the total of the lengths of the break portions 52 of the first electrical discharge trigger wire 50 becomes larger than the electrical discharge gap distance, electrons used for creeping corona discharge, by which electrical discharges are induced, cannot be effectively converged upon the first electrical discharge trigger wire 50 having the break portions 52.

Figure 35:
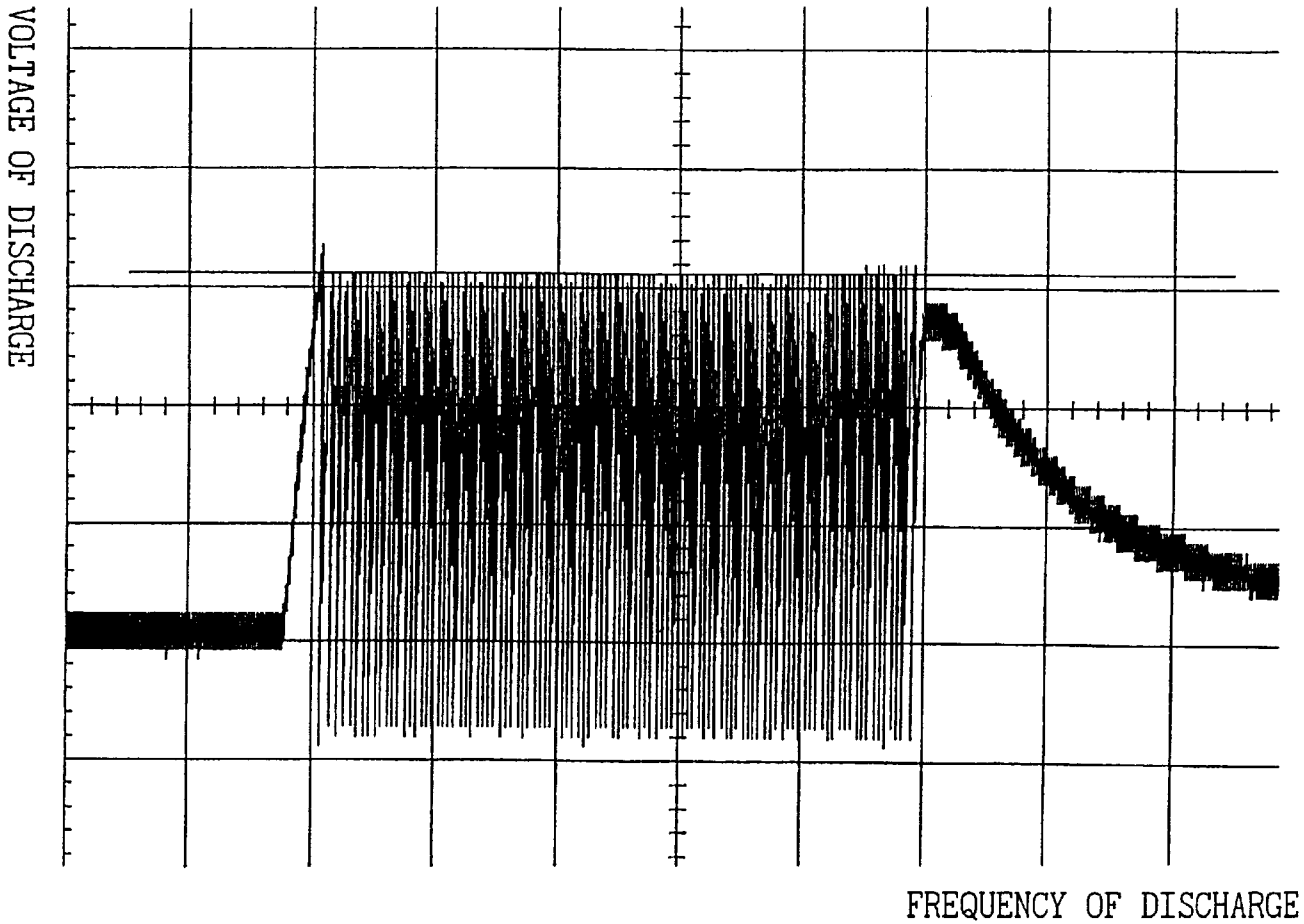
FIGS. 35 and 36 are diagrams respectively showing data of the electrical discharge characteristic of the first electrical discharge tube of the present invention.
Figure 36:
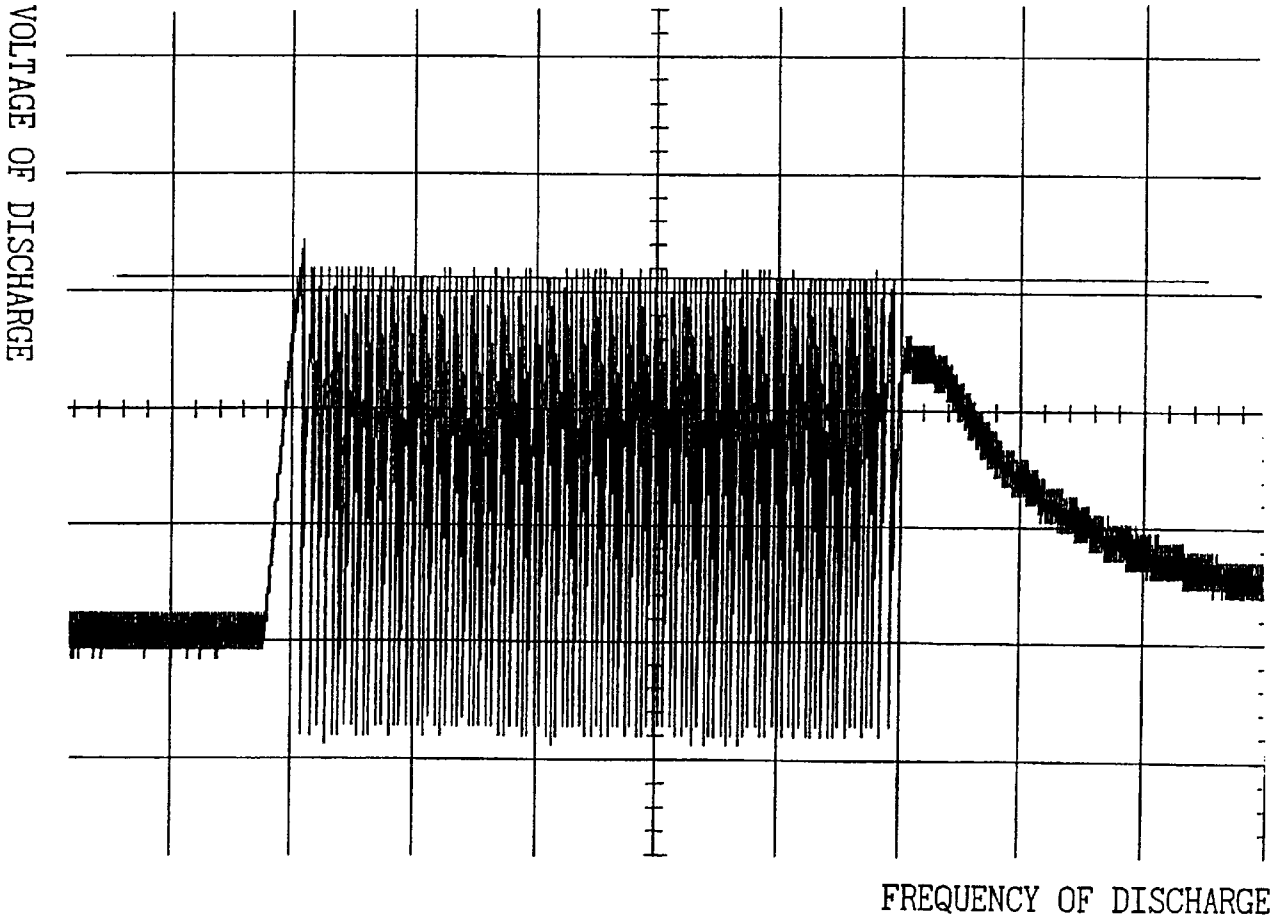
Figure 37:
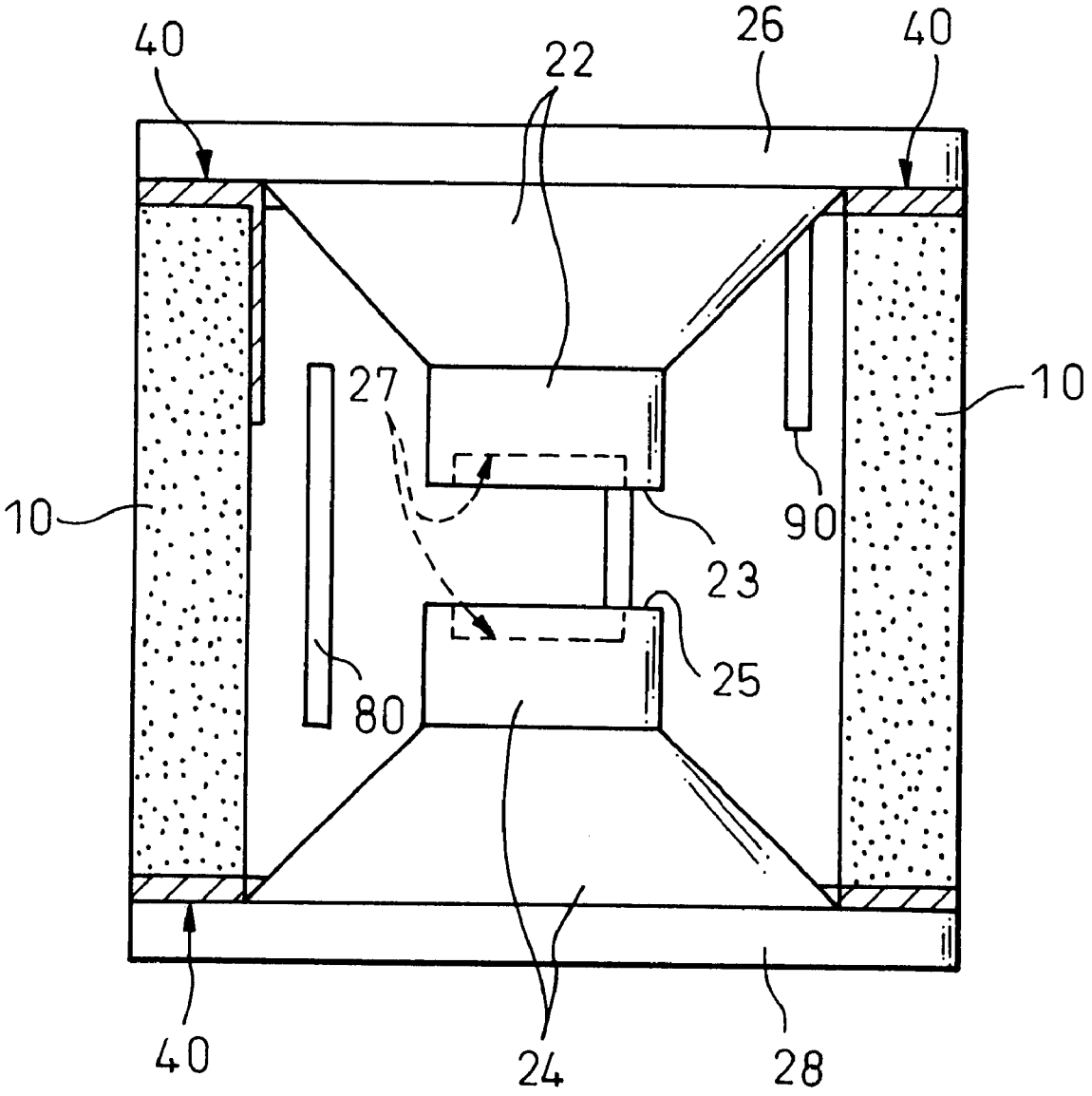
Fig. 37 PRIOR ART
FIG. 37 is a cross-sectional front view showing a conventional electrical discharge tube.
Figure 38:
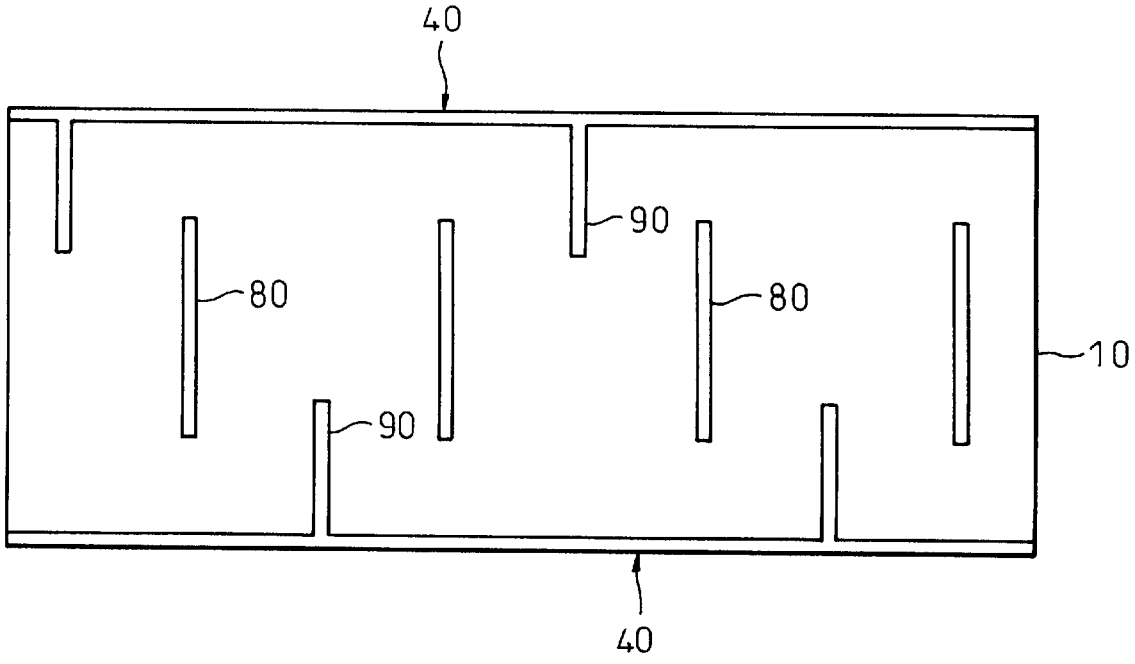
Fig. 38 PRIOR ART
FIG. 38 is a development view showing an inside wall of an airtight cylinder of a conventional electrical discharge tube.

For reference, data of the conventional electrical discharge tube shown in FIGS. 37 and 38 and data of the first electrical discharge tube shown in FIGS. 1 and 2, which are obtained by the experiments, are shown in FIGS. 33 to 36.

Figure 33:
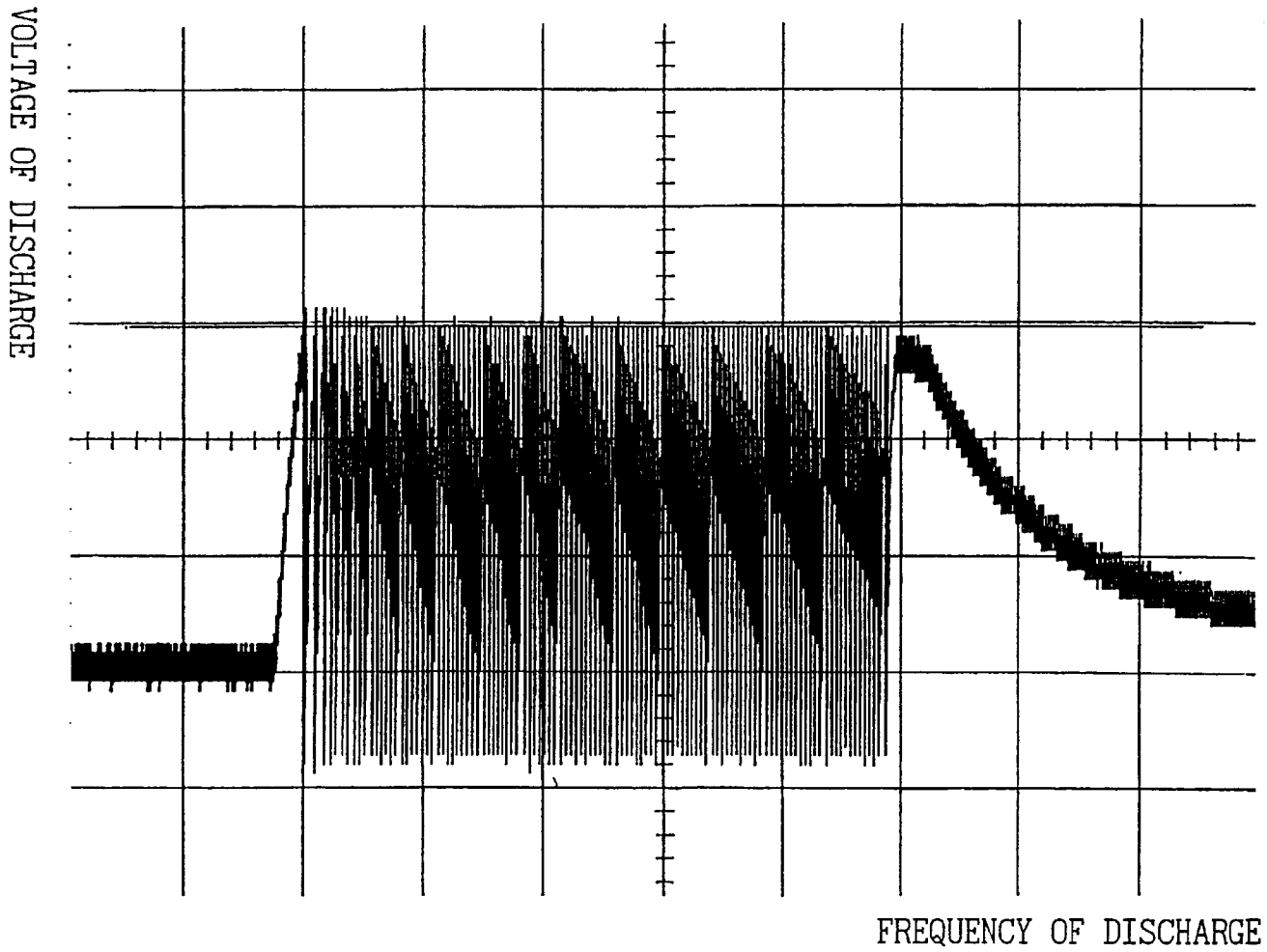
FIGS. 33 and 34 are diagrams showing data of the electrical discharge characteristic of a conventional electrical discharge tube.
Figure 34:
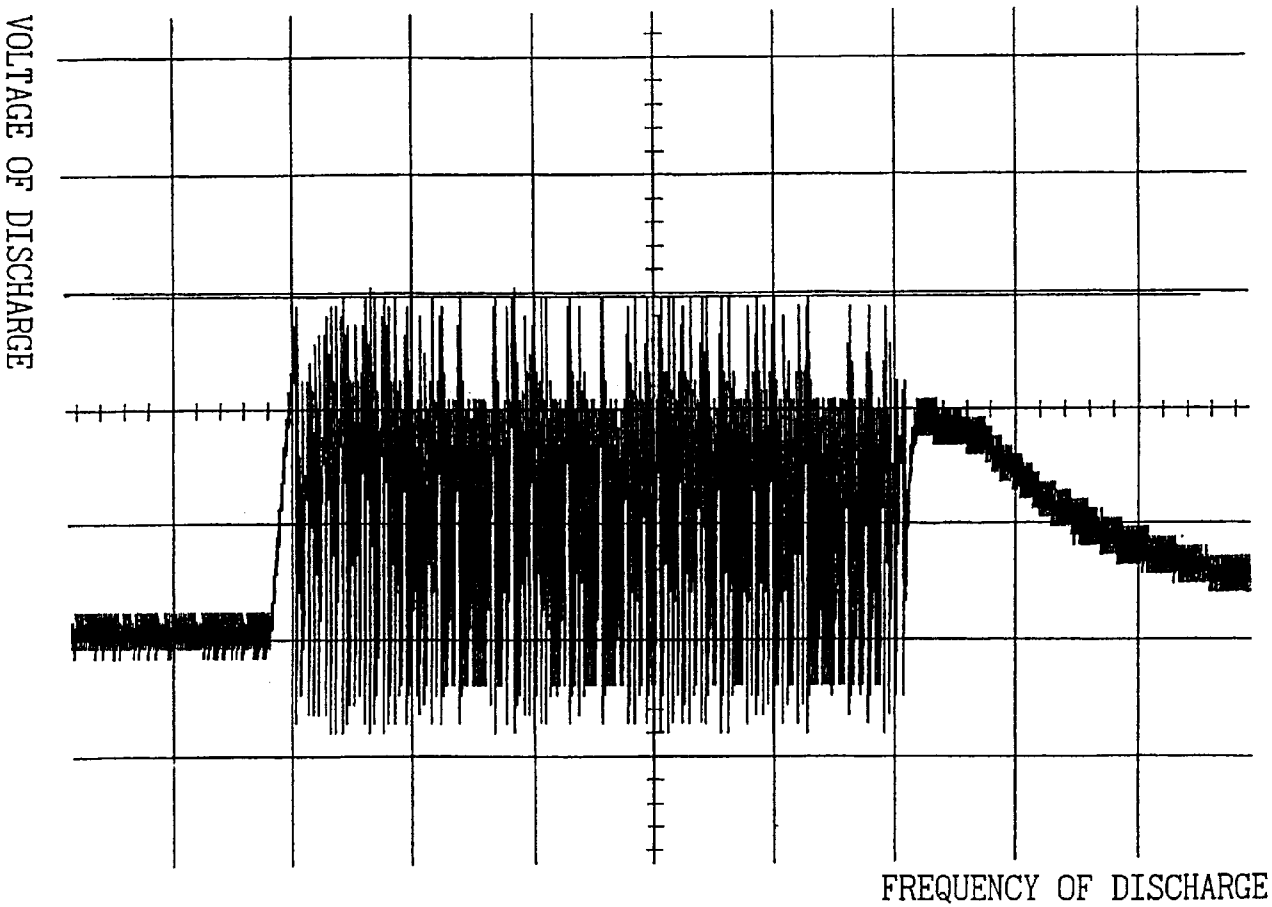

FIG. 33 is the electrical discharge characteristic data of the conventional electrical discharge tube before it is incorporated into the ballast circuit. FIG. 34 is the electrical discharge characteristic data of the conventional electrical discharge tube which is incorporated close to the primary side booster coil in the ballast circuit and embedded in resin. FIG. 35 is the electrical discharge characteristic data of the first electrical discharge tube before it is incorporated into the ballast circuit. FIG. 36 is the electrical discharge characteristic data of the first electrical discharge tube which is incorporated close to the primary side booster coil in the ballast circuit and embedded in the resin. In diagrams, the vertical axis represents the electrical discharge voltage, and the unit scale represents 1000 V. The horizontal axis represents the electrical discharge frequency, and the unit scale represents 200 msec.

According to the electrical discharge characteristic data diagrams shown in FIGS. 33 to 36, compared with the conventional electrical discharge tube shown in FIGS. 37 and 38, the first electrical discharge tube shown in FIGS. 1 and 2 is advantageous in that even if the first electrical discharge tube is incorporated into a portion close to the primary side booster coil in the ballast circuit and embedded in a resin, the first electrical discharge tube is not affected by the primary side booster coil and the resin, so that electrical discharges at a predetermined voltage can be stably and repeatedly induced and the electrical discharge starting voltage at the first time can be kept constant without being raised.

What is claimed is:

1. An electrical discharge tube comprising:

a cylindrical body, made of insulating material, having an inner surface, and having upper and lower end faces defining respective upper and lower openings;

upper and lower metallized layers formed on the respective upper and lower end faces of the cylindrical body, the upper and lower metallized layers being substantially in parallel to each other;

upper and lower electrodes for airtightly closing the respective upper and lower openings by means of the metallized layers, the upper and lower electrodes having respective electrical discharge faces, between which an electrical discharge gap is defined;

a first electrical discharge trigger wire formed as a loop on the inner surface of the cylindrical body and extending substantially in parallel to the first and second metallized layers along a first surface located within a range of the electrical discharge gap;

one or more second electrical discharge trigger wire formed on the inner surface of the cylindrical body and extending from the upper metallized layer to a fourth surface located between a second surface including the electrical discharge face of the upper electrode and the upper metallized layer; and one or more, other, second electrical discharge trigger wire formed on the inner surface of the cylindrical body and extending from the lower metallized layer to a fifth surface located between a third surface including the electrical discharge face of the lower electrode and the lower metallized layer.

2. An electrical discharge tube as set forth in claim 1, wherein the first surface passes through an intermediate position in the electrical discharge gap, the third surface passes through an intermediate position between the second surface and the upper metallized layer, and the fifth surface passes through an intermediate position between the third surface and the lower metallized layer.

3. An electrical discharge tube as set forth in claim 1, wherein the first electrical discharge trigger wire is continuously formed in a circumferential direction.

4. An electrical discharge tube as set forth in claim 1, wherein the first electrical discharge trigger wire has at least one discontinuous portion.

5. An electrical discharge tube as set forth in claim 1, wherein the first electrical discharge trigger wire comprises at least two sub-first trigger wires arranged in parallel and adjacent to each other.

6. An electrical discharge tube as set forth in claim 1, wherein the second electrical discharge trigger wire extends straightly and in parallel to an axis of the cylindrical body.

7. An electrical discharge tube as set forth in claim 1, wherein the second electrical discharge trigger wire comprises at least two sub-second trigger wires arranged in parallel and adjacent to each other.

8. An electrical discharge tube as set forth in claim 1, wherein the second electrical discharge trigger wire extends straightly in a direction of an angle to be inclined with respect to an axis of the cylindrical body.

9. An electrical discharge tube as set forth in claim 1, wherein the one or more second electrical discharge trigger wire extending from the upper metallized layer and the one or more, other, second electrical discharge trigger wire extending from the lower metallized layer are arranged at an interval with respect to each other in a circumferential direction.

10. An electrical discharge tube comprising:

a cylindrical body, made of insulating material, having an inner surface, and having upper and lower end faces defining respective upper and lower openings;

upper and lower metallized layers formed on the respective upper and lower end faces of the cylindrical body, the upper and lower metallized layers being substantially in parallel to each other;

upper, negative and lower, positive electrodes for airtightly closing the respective upper and lower openings by means of the metallized layers, the upper and lower electrodes having respective electrical discharge faces, between which an electrical discharge gap is defined;

a first electrical discharge trigger wire formed as a loop on the inner surface of the cylindrical body and extending substantially in parallel to the first and second metallized layers along a first surface located within a range of the electrical discharge gap; and a plurality of electrical discharge trigger wires formed on the inner surface of the cylindrical body and extending from the upper metallized layer to a fourth surface located between a second surface including the electrical discharge face of the upper, negative electrode and the upper metallized layer.

11. An electrical discharge tube as set forth in claim 10, wherein the first surface passes through an intermediate position in the electrical discharge gap, and the third surface passes through an intermediate position between the second surface and the upper metallized layer.

12. An electrical discharge tube as set forth in claim 10, wherein the first electrical discharge trigger wire is continuously formed in a circumferential direction.

13. An electrical discharge tube as set forth in claim 10, wherein the first electrical discharge trigger wire has at least one discontinuous portion.

14. An electrical discharge tube as set forth in claim 10, wherein the first electrical discharge trigger wire comprises at least two sub-first trigger wires arranged in parallel and adjacent to each other.

15. An electrical discharge tube as set forth in claim 10, wherein the second electrical discharge trigger wire extends straightly and in parallel to an axis of the cylindrical body.

16. An electrical discharge tube as set forth in claim 10, wherein the second electrical discharge trigger wire comprises at least two sub-second trigger wires arranged in parallel and adjacent to each other.

17. An electrical discharge tube as set forth in claim 10, wherein the second electrical discharge trigger wire extends straight at an angle to be inclined with respect to the direction of the axis of the cylindrical body.

* * * * *